US006940360B2

(12) United States Patent
Takeda et al.

(10) Patent No.: US 6,940,360 B2
(45) Date of Patent: Sep. 6, 2005

(54) TWO-PORT ISOLATOR AND METHOD FOR EVALUATING IT

(75) Inventors: Shigeru Takeda, Saitama-ken (JP); Hideto Horiguchi, Tokyo (JP); Yukinori Arita, Tottori-ken (JP); Shinichirou Takeuchi, Tottori-ken (JP); Yasushi Kishimoto, Tottori-ken (JP); Shinji Yamamoto, Tottori-ken (JP)

(73) Assignee: Hitchi Metals, Ltd., Tokyo (JP)

( * ) Notice: Subject to any disclaimer, the term of this patent is extended or adjusted under 35 U.S.C. 154(b) by 162 days.

(21) Appl. No.: 10/108,360

(22) Filed: Mar. 29, 2002

(65) Prior Publication Data

US 2002/0171504 A1 Nov. 21, 2002

(30) Foreign Application Priority Data

| | | |
|---|---|---|
| Mar. 30, 2001 | (JP) | 2001-098589 |
| Apr. 4, 2001 | (JP) | 2001-105382 |
| Apr. 16, 2001 | (JP) | 2001-117461 |
| Aug. 1, 2001 | (JP) | 2001-233692 |

(51) Int. Cl.[7] ..... H01P 1/36
(52) U.S. Cl. ..... 333/24.2; 333/1.1
(58) Field of Search ..... 333/1.1, 24.2

(56) References Cited

U.S. PATENT DOCUMENTS

| | | | | |
|---|---|---|---|---|
| 3,010,085 A | * | 11/1961 | Seidel | 333/24.2 |
| 3,038,133 A | | 6/1962 | De Vries | |
| 4,016,510 A | | 4/1977 | Hodges, III et al. | 333/24.2 |
| 4,101,850 A | | 7/1978 | Dworsky et al. | 333/24.2 |
| 4,210,886 A | | 7/1980 | Enderby et al. | 333/24.2 |
| 5,821,830 A | | 10/1998 | Hasegawa | 333/1.1 |

FOREIGN PATENT DOCUMENTS

| | | |
|---|---|---|
| EP | 0 779 673 | 6/1997 |
| JP | 11 205016 | 7/1999 |

OTHER PUBLICATIONS

Shigeru Takeda, et al., "Improved Lumped–Element Two–Port Isolator," 2003 IEEE MTT–S Digest, pp. 417–420.

Shigeru Takeda, "Off–Band Characteristics of Small Isolator for Portable Phones," 1999 IEEE MTT–S Digest, pp. 1361–1364.

European Search Report, Oct. 27, 2003.

* cited by examiner

*Primary Examiner*—Stephen E. Jones
(74) *Attorney, Agent, or Firm*—Finnegan, Henderson, Farabow, Garrett & Dunner, LLP

(57) ABSTRACT

A two-port isolator comprising a thin ferrite plate, a permanent magnet for applying a static magnetic field to the thin ferrite plate, first and second central conductors disposed substantially in a center portion of the thin ferrite plate and crossing each other with electric insulation, first and second input-output terminals each connected to an end of each of the first and second central conductors, a common terminal connected to the other ends of the first and second central conductors, a first matching capacitor connected between the first input-output terminal and the common terminal, a second matching capacitor connected between the second input-output terminal and the common terminal, and a resistor connected between the first input-output terminal and the second input-output terminal, wherein the DC resistance of the resistor is set, such that with loss in a high-frequency signal entering into the first input-output terminal and exiting from the second input-output terminal defined as insertion loss, and with loss in a high-frequency signal entering into the second input-output terminal and exiting from the first input-output terminal defined as isolation loss, the insertion loss is smaller than the isolation, and that the isolation loss increases as a static magnetic field applied to the two-terminal isolator from outside increases.

10 Claims, 20 Drawing Sheets

TWO-PORT ISOLATOR AND METHOD FOR EVALUATING IT

FIELD OF THE INVENTION

The present invention relates to a two-port isolator having large isolation and small insertion loss in a wide bandwidth, and a method for evaluating it.

BACKGROUND OF THE INVENTION

Generally used as isolators for high-frequency signals at present are three-port circulators whose one terminal is terminated by a matching impedance. Three-port circulators are classified into a distributed element circulator and a lumped element circulator. The circulator has a basic structure comprising a thin ferrite plate, a permanent magnet for applying a magnetic field to the thin ferrite plate perpendicularly, and conductors disposed around the thin ferrite plate, with irreversible electric characteristics. The distributed element is used when the size of the thin ferrite plate is ¼ or more of the wavelength of a high-frequency signal transmitting therethrough. The lumped element circulator is used when the size of the thin ferrite plate is ⅛ or less of the wavelength of a high-frequency signal transmitting therethrough. Accordingly, the lumped element circulator is more suitable for miniaturization than the distributed element circulator.

FIG. 7 is a schematic view showing an isolator circuit used for cell phones, etc. at present, which is constituted by connecting a matching impedance (resistor R) to one port of the three-port, lumped element circulator. Three central conductors $L_1$, $L_2$, $L_3$ are disposed at an equal interval of 120° on the upper surface of a thin ferrite plate G composed of garnet-type ferrite. One end of each central conductor $L_1$, $L_2$, $L_3$ serves as an input-output line for a terminal (1), (2), (3), and the other end is connected to a common terminal GR serving as a ground. Matching capacitors $C_1$, $C_2$, $C_3$ are parallel-connected between the ends of the central conductors $L_1$, $L_2$, $L_3$ and the common terminal GR. To operate as an isolator, an energy-absorbing resistor R is connected between the terminal (3) and the common terminal GR.

To apply a static magnetic field to the main surface of the thin ferrite plate G substantially in perpendicular thereto, a permanent magnet (not shown) is mounted onto a casing serving as a magnetic yoke. In the isolator shown in FIG. 7, at the desired frequency (hereinafter referred to as "center frequency") $f_0$, a high-frequency signal entering into the terminal (1) is transmitted to the terminal (2), and a high-frequency signal entering into the terminal (2) is transmitted to the terminal (3), respectively with small loss. However, because a resistor R is connected to the terminal (3), almost all energy is absorbed thereby, so that substantially no high-frequency signal is transmitted from the terminal (2) to the terminal (1). Thus, high-frequency signal is transmitted only in one direction in this isolator, with a high-frequency signal in the opposite direction prevented from transmission.

Though the isolator shown in FIG. 7 is advantageous in having small insertion loss in a wide bandwidth, it is disadvantageous in that its bandwidth in which large isolation loss is obtained is narrow. Because three central conductors cross at an angle of 120°, the coupling of the central conductors at a frequency quite higher than the desired frequency $f_0$ cannot be neglected. A second peak of transmission loss thus appears in a high-frequency signal at about 1.4 $f_0$ [S. Takeda; 1999 IEEE MTT-S Digest, pp. 1361–1364 (WEF 3-1)]. As a result, the isolation loss is degraded to about 5 dB. Under this influence, there is no large attenuation in a high-frequency signal in an opposite direction at $2f_0$ and $3f_0$.

On the other hand, the two-port isolator shown in FIG. 6 comprises two central conductors $L_1$, $L_2$ crossing perpendicularly. See, for instance, Japanese Patent Laid-Open No. 52-134349 (U.S. Pat. No. 4,016,510), and Japanese Patent Laid-Open No. 53-129561 (U.S. Pat. No. 4,101,850). Because of this structure, it is advantageous in that high attenuation in an opposite direction is obtained in a high-frequency even deviated from near a center frequency $f_0$ called "within bandwidth", at which a normal isolator operation is carried out.

In the two-port isolator having this structure, matching capacitors $C_1$, $C_2$ are connected in parallel between ends of the central conductors $L_1$, $L_2$ and the common terminal GR. An important feature of the two-port isolator is that two terminals of the energy-absorbing resistor R are connected to ends of the central conductors $L_1$, $L_2$. The other ends of the central conductors $L_1$, $L_2$ are connected to the common terminal GR as a ground. Because the two-port isolator is smaller than the three-port circulator by one central conductor and one matching capacitor, it is suitable for a small, thin isolator.

However, the two-port isolator having the structure shown in FIG. 6 has not been put into widespread practical use. The reason is that because the two-port isolator is disadvantageous in having a narrow bandwidth in which small insertion loss is obtained, though large isolation is obtained in a wide bandwidth, the insertion loss of the two-port isolator cannot be reduced to much smaller than that of the three-port circulator. One example of expanding the bandwidth may be to reduce a normalized operating magnetic field $\sigma$ by making a static magnetic field applied to a thin ferrite plate smaller. However, this leads to an increase in insertion loss, because the ferrite has a large magnetic loss.

In addition, the operation principle of the two-port isolator has not been investigated in detail unlike the three-port circulator. Therefore, the inventions have developed a circuit simulator for analyzing the circuit of FIG. 6, and got a fundamental knowledge to large isolation loss and small insertion loss in a wide bandwidth based on the analysis results. The operation principle of FIG. 6 will be described below based on the circuit analysis.

When a high-frequency signal enters into the circuit through the terminal (1), electric current flows in the central conductor $L_1$, thereby exciting the thin ferrite plate G. Because the thin ferrite plate G is magnetized in a direction of its main surface by the permanent magnet, a high-frequency magnetic field is generated from the thin ferrite plate G, exciting electric current in the central conductor $L_2$ in perpendicular to the central conductor $L_1$. This is due to the ferromagnetic resonant effect of ferrite in a microwave band. Because of this effect, the central conductor $L_1$ is coupled to the central conductor $L_2$, thereby enabling the transmission of a high-frequency energy from the central conductor $L_1$ to the central conductor $L_2$.

Respective pairs of the matching capacitors $C_1$, $C_2$ and the central conductors $L_1$, $L_2$ constitute parallel resonance circuits resonating at a center frequency $f_0$. What should be paid attention is the change of phase when a high-frequency energy is transmitted. Namely, when energy is transmitted from the terminal (1) to the terminal (2), its phase difference is 0°, no electric current flows through the resistor R if the input and the output have the same amplitude. To the contrary, when energy is transmitted from the terminal (2) to the terminal (1), its phase difference is just 180°. In this case, large electric current flows through the energy-absorbing resistor R, resulting in the consumption of energy. Thus, energy is unlikely to be transmitted from the terminal (2) to the terminal (1).

FIGS. 3(*a*) and (*b*) show the insertion loss, isolation and reflection loss of such a conventional two-port isolator by the solid line. In the figure, a white triangle on the axis of ordinates indicates a reference line of 0 dB. As shown in FIG. 6, this two-port isolator has a structure in which a thin garnet plate G having a diameter of 3.9 mm and a thickness of 0.4 mm is disposed in a 7-mm-square iron casing having a ferrite magnet fixed to an inner surface thereof, two perpendicularly crossing central conductors $L_1$, $L_2$ are disposed in the vicinity of the ferrite magnet, and ceramic capacitors $C_1$, $C_2$ are added. The resistance of the resistor R is 50Ω. FIG. 3(*a*) shows the frequency characteristics of insertion loss and reflection loss of an input port (corresponding to the terminal (1) in FIG. 6), and FIG. 3(*b*) shows the frequency characteristics of isolation loss and reflection loss of an output port (corresponding to the terminal (2) in FIG. 6).

The minimum value (0.58 dB) of insertion loss occurs at a frequency of 1140 MHz (center frequency $f_0$). This value is larger than the insertion loss of the three-port circulator by 0.2–0.3 dB. The isolation loss is about 11 dB at a center frequency $f_0$, which is not necessarily so good. The frequency characteristics of the isolation loss of the two-port isolator are in an upward projecting curve, unlike a downward projecting curve in the three-port circulator.

FIG. 4 shows the insertion loss and isolation loss of the above two-port isolator measured in a wider frequency range than in FIG. 3. FIG. 4(*a*) shows the frequency characteristics of insertion loss and reflection loss of an input port, and FIG. 4(*b*) shows the frequency characteristics of isolation loss and reflection loss of an output port. FIGS. 4(*a*) (*b*) show attenuation at 2 $f_0$, 3 $f_0$, wherein $f_0$ is a frequency of 1140 MHz at which the insertion loss is minimum. FIG. 4(*b*) also shows the insertion loss of FIG. 4(*a*) by a dotted line for comparison. As is clear from both figures, this isolator reflects almost all at frequencies of 2 $f_0$ and 3 $f_0$ outside the bandwidth, with the attenuation of transmission of about 30 dB. What is better is that there is no unnecessary resonance as seen in the three-port circulator. The insertion loss and isolation loss have upward curved frequency characteristics.

Another example of the two-port isolator has a structure in which two central conductors are sandwiched by two thin ferrite plate pieces. FIG. 8 shows the arrangement of central conductors $L_1$, $L_2$ and a thin ferrite plate G in such a two-port isolator. FIG. 8(*a*) is a plan view showing the arrangement of a first thin ferrite plate piece $G_1$ and two central conductors $L_1$, $L_2$, with a second thin ferrite plate piece $G_2$ omitted. FIG. 8(*b*) is a cross-sectional view taken along the line A—A in FIG. 8(*a*). The second central conductor $L_2$ is perpendicularly disposed on the first central conductor $L_1$ via an insulating layer. The second thin ferrite plate piece $G_2$ is in close contact with the second central conductor $L_2$. The arrow MF indicates a high-frequency magnetic field induced by a high-frequency electric current flowing through the central conductor $L_1$.

Because a high-frequency magnetic field passes through a gap between the thin ferrite plate pieces $G_1$, $G_2$, the thin ferrite plate pieces $G_1$, $G_2$ cannot be excited efficiently because of a demagnetizing field in the gap. As a result, strong coupling cannot be obtained between the two central conductors $L_1$, $L_2$. It has been found by simulation that in a two-port isolator comprising central conductors $L_1$, $L_2$ crossing perpendicularly, the poor coupling of the central conductors $L_1$, $L_2$ leads to deterioration in insertion loss. When the second thin ferrite plate piece $G_2$ is not used, coupling is further poor between the central conductors $L_1$, $L_2$. The solid lines in FIGS. 3(*a*) and (*b*) indicate the insertion loss, isolation loss and reflection loss of a two-port isolator comprising a thin ferrite plate consisting only of a first thin ferrite plate piece $G_1$ without using a second thin ferrite plate piece $G_2$.

FIG. 16(*a*) shows a combination of central conductors $L_1$, $L_2$ having two parallel conductor portions and a first, rectangular, thin ferrite plate $G_1$ in the conventional two-port isolator, and FIG. 16(*b*) shows a second thin ferrite plate piece $G_2$ disposed on the second central conductor $L_2$ in close contact. The coupling of the central conductors $L_1$, $L_2$ is slightly larger in the assembly shown in FIG. 16 than in the assembly comprising a thin, circular ferrite plate as shown in FIG. 8.

The structure shown in FIG. 17 is the same as that shown in FIG. 16 except that two central conductors $L_1$, $L_2$ are knitted. Because of this structure, the coupling of the two central conductors $L_1$, $L_2$ can be improved.

It has been found by simulation that in a two-port isolator comprising central conductors $L_1$, $L_2$ crossing perpendicularly, the poor coupling of central conductors $L_1$, $L_2$ leads to deterioration in insertion loss. It has been found by analyzing the conventional structures shown in FIGS. 16 and 17 that two central conductors $L_1$, $L_2$ are not necessarily coupled efficiently throughout the rectangular, thin ferrite plate pieces $G_1$, $G_2$. Coupling was insufficient between the two central conductors particularly in the peripheral portions of the thin ferrite plates.

Practically, there is capacitance between the first and second central conductors, and there is parasitic inductance in series to a resistor. When such a parasitic element exists, the desired operation cannot be expected. It is thus desired to optimize by simulation the circuit characteristics of a two-port lumped element isolator. When the crossing angle $\phi$ of a center axis of the first central conductor $L_1$ and a center axis of the second central conductor $L_2$ is changed, simulation as to how these inter-conductor capacitance and parasitic inductance change is described in U.S. Pat. No. 4,210,886. However, its theoretical consideration is not clear, and the resultant crossing angle is not necessarily acceptable for practical purposes.

As described above, though the conventional two-port isolator provides large isolation loss in a wide bandwidth, it is disadvantageous in having large insertion loss at a center frequency $f_0$ and a narrow bandwidth in which small insertion loss is obtained.

OBJECTS OF THE INVENTION

Accordingly, an object of the present invention is to provide a two-port isolator having large isolation loss and small insertion loss in a wide bandwidth.

Another object of the present invention is to provide a method for evaluating such a two-port isolator.

DISCLOSURE OF THE INVENTION

Thus, the first two-port isolator of the present invention comprises a thin ferrite plate, a permanent magnet for applying a static magnetic field to the thin ferrite plate, first and second central conductors disposed substantially in a center portion of the thin ferrite plate and crossing each other with electric insulation, first and second input-output terminals each connected to an end of each of the first and second central conductors, a common terminal connected to the other ends of the first and second central conductors, a first matching capacitor connected between the first input-output terminal and the common terminal, a second matching capacitor connected between the second input-output terminal and the common terminal, and a resistor connected between the first input-output terminal and the second input-output terminal, wherein the DC resistance of the resistor is set, such that with loss in a high-frequency signal entering into the first input-output terminal and exiting from the second input-output terminal defined as insertion loss, and with loss in a high-frequency signal entering into the second input-output terminal and exiting from the first input-output terminal defined as isolation loss, the insertion loss is smaller than the isolation loss, and that the isolation loss increases as a static magnetic field applied to the two-port isolator from outside increases.

The isolation loss of the two-port isolator preferably increases by 1 dB or more, when a static magnetic field applied to the two-port isolator from outside increases by 800 A/m or more. A static magnetic field applied to the two-port isolator from outside is increased preferably by bringing a permanent magnet close to a casing serving as a magnetic yoke of the two-port isolator from above.

The isolation loss of the two-port isolator preferably increases by 1 dB or more, when a permanent magnet having a residual magnetic flux density of 0.5 T or more is brought close to the casing within 50 mm from above. The resistor preferably has DC resistance of 60–100Ω.

The isolation is preferably 10 dB or more in a frequency range of 0.8 $f_0$ to 3 $f_0$, wherein $f_0$ is a frequency at which the insertion loss is minimum.

The method for evaluating a two-port isolator of the present invention, which comprises a thin ferrite plate, a permanent magnet for applying a static magnetic field to the thin ferrite plate, first and second central conductors disposed substantially in a center portion of the thin ferrite plate and crossing each other with electric insulation, first and second input-output terminals each connected to an end of each of the first and second central conductors, a common terminal connected to the other ends of the first and second central conductors, a first matching capacitor connected between the first input-output terminal and the common terminal, a second matching capacitor connected between the second input-output terminal and the common terminal, and a resistor connected between the first input-output terminal and the second input-output terminal in a casing, comprises connecting the two-port isolator to an outside circuit; gradually bringing a permanent magnet close to the casing from outside to observe isolation loss while increasing a static magnetic field, wherein if the isolation increases by 1 dB or more when the static magnetic field increases by 800 A/m or more, it is determined that the resistance is properly larger than an outside circuit impedance (impedance of the outside circuit viewed from the two-port isolator), whereby the resistance of the resistor is judged good.

The second two-port isolator of the present invention comprises a thin ferrite plate, a permanent magnet for applying a static magnetic field to the thin ferrite plate, first and second central conductors disposed substantially in a center portion of the thin ferrite plate and crossing each other with electric insulation, first and second input-output terminals each connected to an end of each of the first and second central conductors, a common terminal connected to the other ends of the first and second central conductors, a first matching capacitor connected between the first input-output terminal and the common terminal, a second matching capacitor connected between the second input-output terminal and the common terminal, and a resistor connected between the first input-output terminal and the second input-output terminal, wherein the thin ferrite plate is constituted by one or more thin ferrite plate pieces, at least one thin ferrite plate piece being provided with a groove for receiving part of the central conductor.

The thin ferrite plate is preferably formed by stacking at least two thin ferrite plate pieces, a first thin ferrite plate piece having a groove for receiving part of the central conductors, and a second thin ferrite plate piece being stacked thereon.

The thin ferrite plate is preferably constituted by first and second thin ferrite plate pieces, the first thin ferrite plate piece having a first groove for receiving part of the first central conductor, and the second thin ferrite plate having a second groove for receiving part of the second central conductor.

A plurality of thin ferrite plate pieces are preferably in contact with each other in regions other than the groove.

A thin ferrite plate constituted by first and second thin ferrite plate pieces is preferably contained in a casing serving as a magnetic yoke having an inner surface, to which a permanent magnet is fixed; the first thin ferrite plate piece being disposed on the bottom side of the casing, while the second thin ferrite plate piece is disposed on the permanent magnet side; and the second thin ferrite plate piece having a larger saturation magnetization than that of the first thin ferrite plate piece. The difference in a saturation magnetization between the first thin ferrite plate piece and the second thin ferrite plate piece is preferably in a range of 0.005 T–0.02 T.

The third two-port isolator of the present invention comprises a thin ferrite plate, a permanent magnet for applying a static magnetic field to the thin ferrite plate, first and second central conductors disposed substantially in a center portion of the thin ferrite plate and crossing each other with electric insulation, first and second input-output terminals each connected to a end of each of the first and second central conductors, a common terminal connected to the other ends of the first and second central conductors, a first matching capacitor connected between the first input-output terminal and the common terminal, a second matching capacitor connected between the second input-output terminal and the common terminal, and a resistor connected between the first input-output terminal and the second input-output terminal, wherein the thin ferrite plate is in a rectangular shape, and wherein the first and second central conductors each having three or more conductor portions are disposed on the rectangular, thin ferrite plate in parallel with its side.

The first and second central conductors are preferably disposed between a plurality of thin ferrite plate pieces. The width of the central conductor is preferably ½ or more of a distance between the opposing sides of the thin ferrite plate in parallel with the central conductor.

The first and second central conductors are preferably disposed between the first and second thin ferrite plate pieces in close contact therewith, a static magnetic field being applied on the side of the second thin ferrite plate piece from the permanent magnet, and the second thin ferrite plate piece having a larger saturation magnetization than that of the first thin ferrite plate piece.

The fourth two-port isolator of the present invention comprises a thin ferrite plate, a permanent magnet for applying a static magnetic field to the thin ferrite plate, first and second central conductors disposed substantially in a center portion of the thin ferrite plate and crossing each other with electric insulation, first and second input-output terminals each connected to an end of each of the first and second central conductors, a common terminal connected to the other ends of the first and second central conductors, a first matching capacitor connected between the first input-output terminal and the common terminal, a second matching capacitor connected between the second input-output terminal and the common terminal, and a resistor connected between the first input-output terminal and the second input-output terminal, wherein a crossing angle (on the resistor side) of the center axis of the first central conductor and the center axis of the second central conductor is in a range of 40–80°.

A third capacitor is preferably connected in parallel with the resistor. The third capacitor preferably has smaller static capacitance than those of the first and second matching capacitors.

An inductor is preferably connected in parallel with or in series to the resistor.

The common terminal is preferably connected to a ground.

BRIEF DESCRIPTION OF THE DRAWINGS

FIG. 1(*b*) is a graph showing the frequency characteristics of insertion loss, isolation loss and reflection loss at an input terminal in the two-port isolator when the resistor has a resistance of 50Ω for comparison;

FIG. 1(*c*) is a graph showing the frequency characteristics of insertion loss, isolation loss and reflection loss at an input terminal in the two-port isolator of the present invention when the resistor has a resistance of 55Ω;

FIG. 2(*b*) is a graph showing the relation between isolation loss at a center frequency and the specific bandwidth of the reflection loss and the resistance of the resistor;

FIG. 3(*b*) is a graph showing the frequency characteristics of the isolation loss of the two-port isolator and the reflection loss of the output terminal;

FIG. 4(*b*) is a graph showing the frequency characteristics of the isolation loss of the conventional two-port isolator and the reflection loss of the output terminal;

FIG. 8(*b*) is a cross-sectional view taken along the line A—A in FIG. 8(*a*);

FIG. 9(*b*) is a cross-sectional view showing an assembly of the first and second thin ferrite plate pieces and the central conductor;

FIG. 10(*b*) is a plan view showing the second thin ferrite plate piece according to another embodiment of the present invention;

FIG. 10(*c*) is a cross-sectional view showing an assembly of first and second thin ferrite plate pieces and central conductors according to another embodiment of the present invention;

FIG. 11(*b*) is a plan view and a cross-sectional view showing the second thin ferrite plate piece according to a still further embodiment of the present invention;

FIG. 11(*c*) is a cross-sectional view showing an assembly of first and second thin ferrite plate pieces and central conductors according to a still further embodiment of the present invention;

FIG. 12(*b*) is a plan view and a cross-sectional view showing the second thin ferrite plate piece according to a still further embodiment of the present invention;

FIG. 12(*c*) is a cross-sectional view showing an assembly of first and second thin ferrite plate pieces and central conductors according to a still further embodiment of the present invention;

FIG. 13(*b*) is a plan view and a cross-sectional view showing the first thin ferrite plate piece of FIG. 13(*a*);

FIG. 14(*b*) is a plan view showing the first thin ferrite plate piece of FIG. 14(*a*);

FIG. 16(*b*) is a plan view showing a second, rectangular, thin ferrite plate piece to be combined with the first thin ferrite plate piece of FIG. 16(*a*);

FIG. 18(*b*) is a plan view showing a second thin ferrite plate piece to be combined with the first thin ferrite plate piece of FIG. 18(*a*);

FIG. 22(*b*) is a perspective view showing the thin ferrite plate of FIG. 22(*a*);

FIG. 24(*b*) is a graph showing the frequency characteristics of the insertion loss of the two-port isolator;

FIG. 24(*c*) is a graph showing the frequency characteristics of the isolation loss of the two-port isolator;

DESCRIPTION OF THE PREFERRED EMBODIMENTS

Figure 1A:
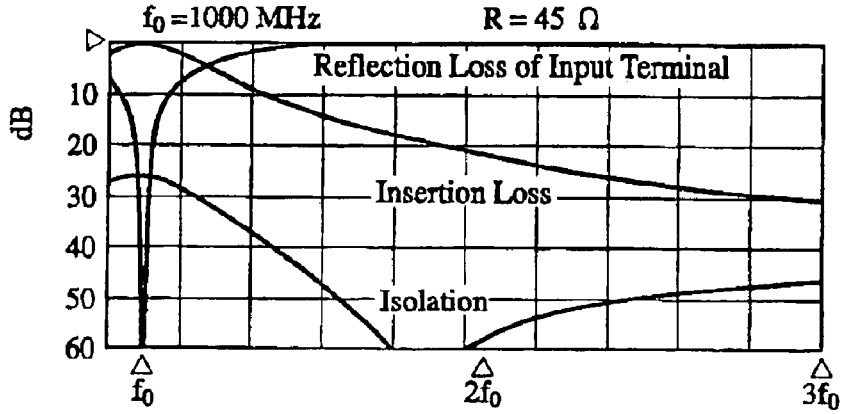
FIG. 1(*a*) is a graph showing the frequency characteristics of insertion loss, isolation loss and reflection loss at an input terminal in the two-port isolator when the resistor has a resistance of 45Ω for comparison.
Figure 1B:
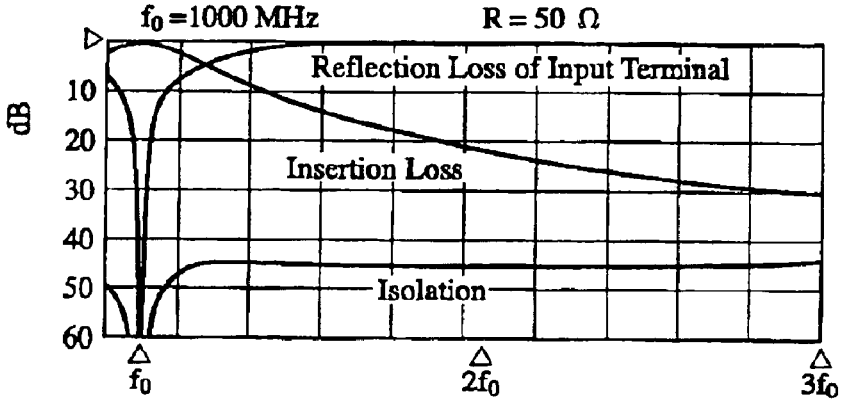
Figure 1C:
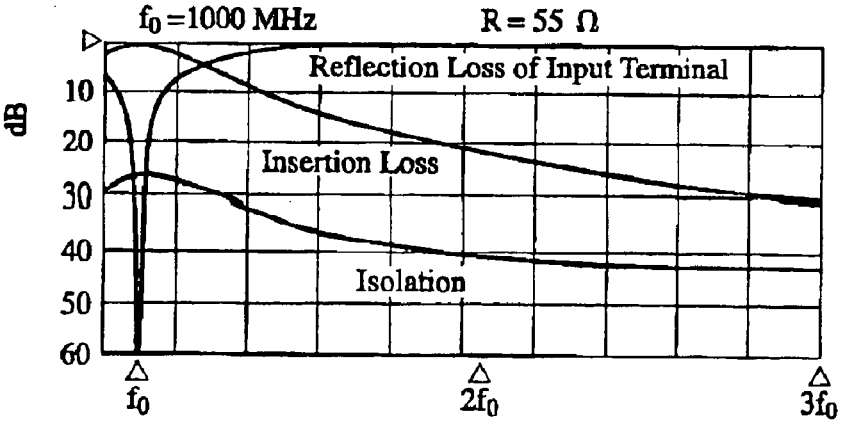

FIG. 1 shows the frequency characteristics of the two-port isolator when the outside circuit impedance is 50Ω. The outside circuit impedance is the impedance of an outside circuit to which the two-port isolator is connected, when viewed from the two-port isolator. FIG. 1(*a*) shows a case where the resistor R is 45Ω, FIG. 1(*b*) shows a case where the resistor R is 50Ω, and FIG. 1(*c*) shows a case where the resistor R is 55Ω. In every case, assuming that the center frequency $f_0$ is 1000 MHz, and that the equivalent circuit is an ideal circuit, insertion loss, isolation loss and the reflection loss of the input terminal in the two-port isolator were calculated by simulation. In FIG. 1, the frequency extends to the higher frequency side, particularly 2 $f_0$ and 3 $f_0$.

As is clear from FIG. 1(*b*), when the resistor R is equal to the outside circuit impedance of 50Ω, the isolation loss is infinite, the insertion loss is zero, and the reflection loss is infinite at a center frequency $f_0$. On the higher frequency side, the insertion loss tends to monotonously increase, without a particular singular point. The isolation loss is substantially flat on the higher frequency side, showing high attenuation of about 45 dB. The reflection loss of the input terminal is almost in a complete reflection state on the higher frequency side.

As shown in FIG. 1(*a*), the insertion loss and the reflection loss of the input terminal when the resistor R is 45Ω are not largely different from those when the resistor R is 50Ω. However, the isolation largely changes with attenuation of 25 dB at a center frequency $f_0$. The isolation loss increases on the higher frequency side, showing an attenuation pole at a frequency of about 1.8 $f_0$.

As shown in FIG. 1(*c*), the insertion loss and the reflection loss of the input terminal when the resistor R is 55Ω are not largely different from those at 50Ω. However, the isolation loss is largely different from that at R=50Ω, with the attenuation of 27 dB at a center frequency $f_0$. The isolation loss slowly and monotonously increases on the higher frequency side, without a singular point as shown in FIG. 1(*a*).

Figure 2A:
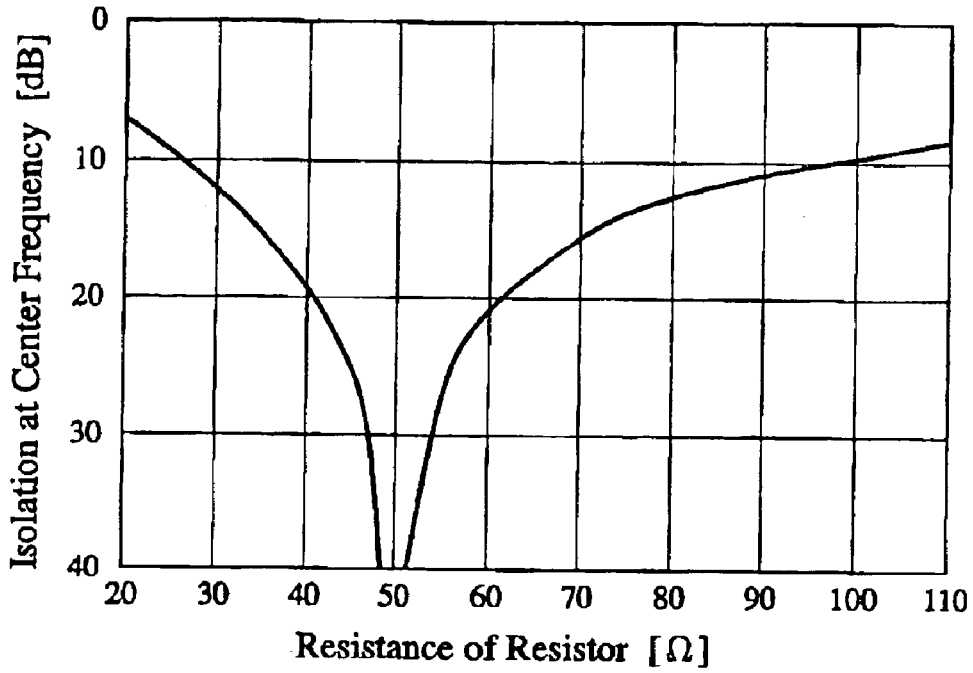
FIG. 2(*a*) is a graph showing the relation between isolation loss at a center frequency and the resistance of the resistor.
Figure 2B:
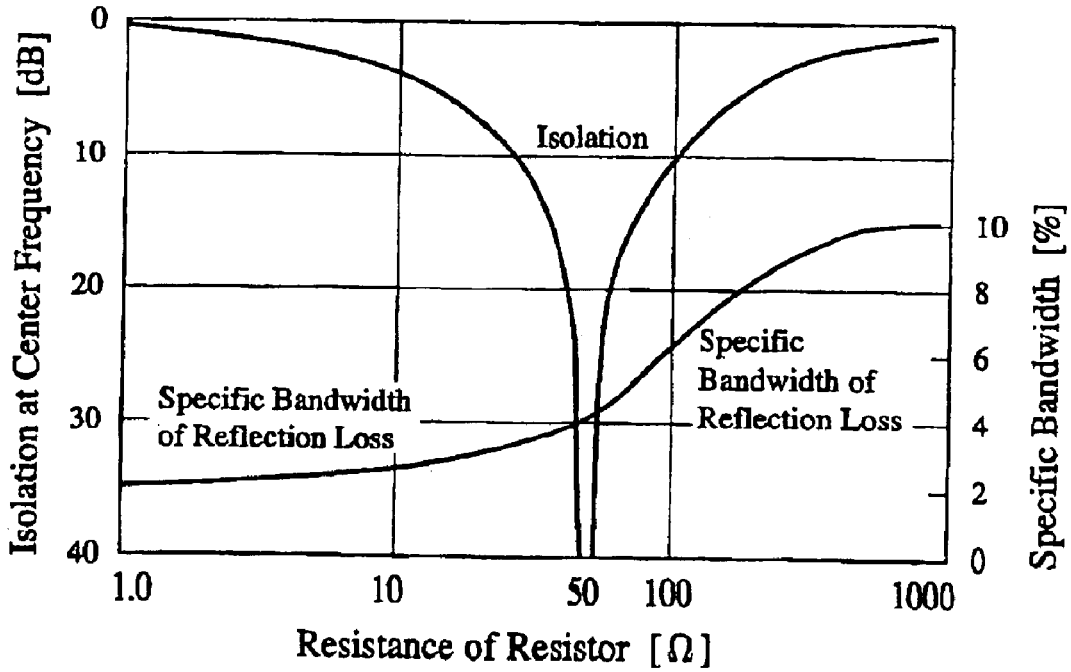

FIG. 2(*a*) shows the calculation results of the isolation loss by simulation at a center frequency in a range of the resistor R of 20–110Ω. As is clear from FIG. 2(*a*), the isolation loss decreases regardless of whether the resistance of the resistor R is smaller or larger than the outside circuit impedance of 50Ω. With the lower limit of the isolation set at 10 dB from the practical point of view, the resistor R should be in a range of 25–100Ω.

FIG. 2(*b*) shows the isolation loss determined at a center frequency in a wide resistance range of 1–1000Ω, wider than the range of the resistance of the resistor R in FIG. 2(*a*). FIG. 2(*b*) shows a specific bandwidth of the reflection loss of the input terminal (percentage of a frequency width when the reflection loss reaches 20 dB to a center frequency $f_0$) in addition to the isolation loss. As is clear from FIG. 2(*b*), the isolation loss has a singular point when the resistance of the resistor R is 50Ω, though the specific bandwidth tends to monotonously increase as the resistance of the resistor R increases. Namely, while the specific bandwidth is about 2% in a small R region, it is 10% in a large R region, close to an open state.

Figure 6:
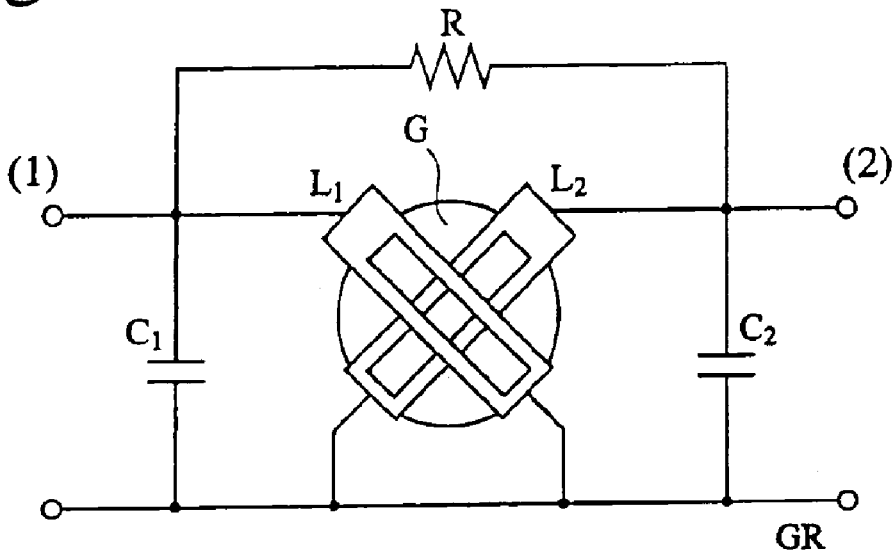
Fig. 6 (PRIOR ART)
FIG. 6 is a view showing an equivalent circuit of the two-port isolator, to which the present invention is applicable.
Figure 7:
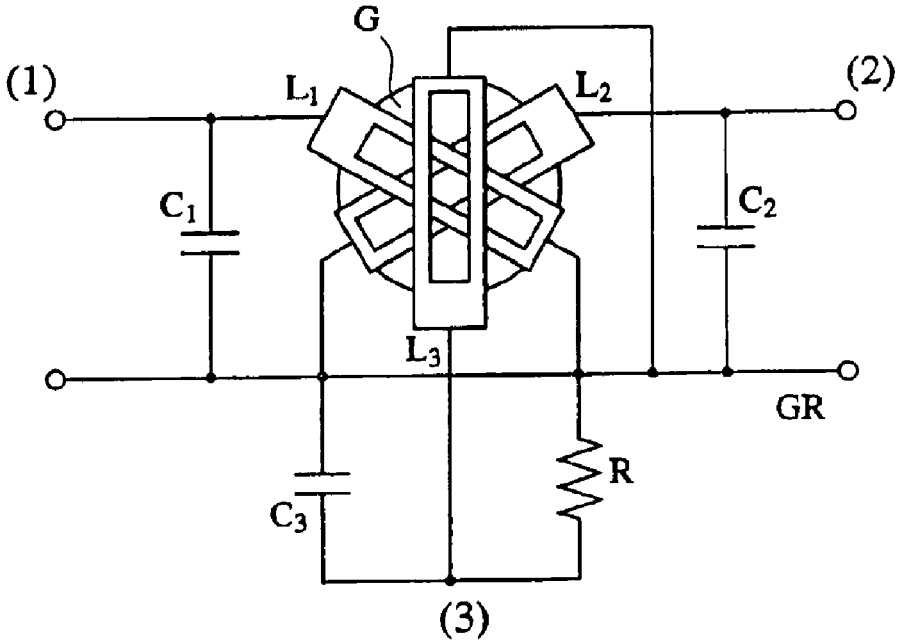
Fig. 7 (PRIOR ART)
FIG. 7 is a view showing an equivalent circuit of an isolator constituted based on a three-port circulator.
Figure 8A:
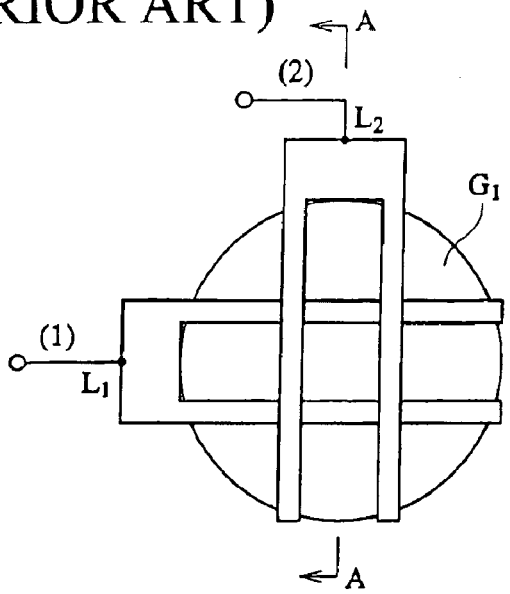
Fig. 8(a) (PRIOR ART)
FIG. 8(*a*) is a plan view showing an assembly of central conductors and a thin ferrite plate for the two-port isolator.
Figure 8B:
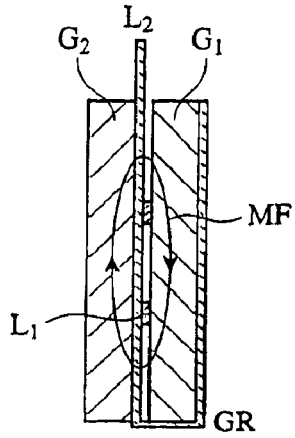
Fig. 8(b) (PRIOR ART)

It may thus be concluded that the two-port isolator having the equivalent circuit shown in FIG. 6 loses irreversible characteristics as an isolator, when the resistance of the resistor R is too larger or smaller than 50Ω. Namely, there is a desired range in the resistance of the resistor R.

The crux of the present invention is to expand a bandwidth in which low insertion loss is obtained in the two-port isolator as much as possible, without decreasing the isolation loss. This has been achieved by expanding the bandwidth of the reflection loss of the input terminal as shown in FIG. 2(*b*). From this point of view, the optimum resistance of the resistor R was determined.

In the two-port isolator of the present invention, the specific bandwidth of the reflection loss should be practically 4% or more. Accordingly, to expand the bandwidth of the reflection loss of the input terminal, it is clear from FIG. 2(*b*) that the resistance of the resistor R should be larger than the outside circuit impedance (50Ω). Also, to make the maximum of the isolation 10 dB or more, it is clear from FIG. 2(*a*) that the resistance of the resistor R should be 100Ω or less.

Figure 3A:
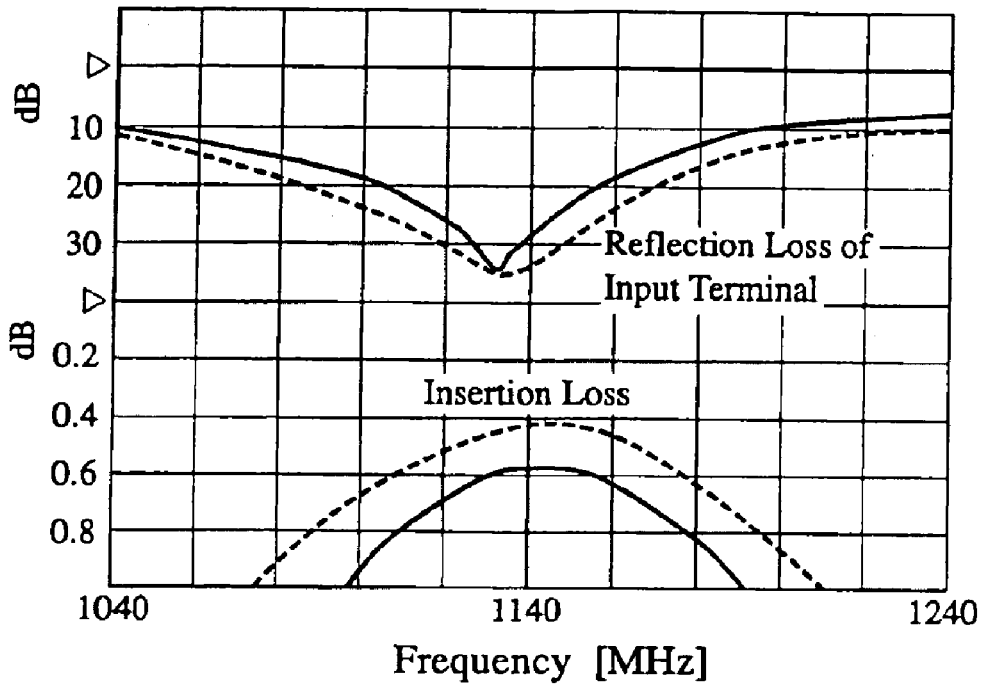
Fig. 3(a) (PRIOR ART)
FIG. 3(*a*) is a graph showing the frequency characteristics of the insertion loss of the two-port isolator and the reflection loss of the input terminal.
Figure 3B:
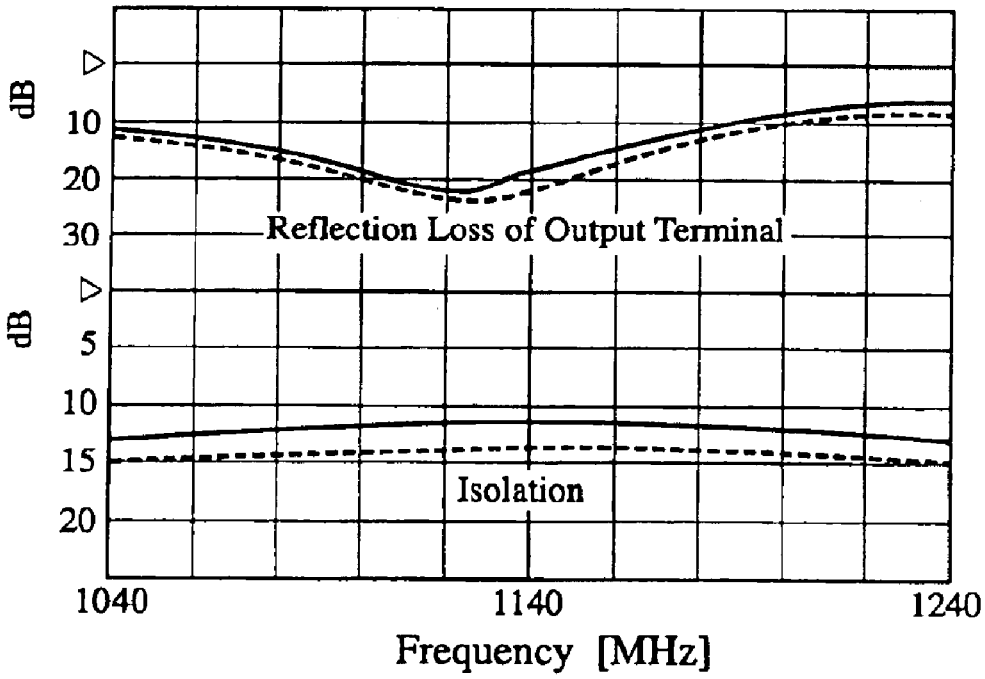
Fig. 3(b) (PRIOR ART)
Figure 4A:
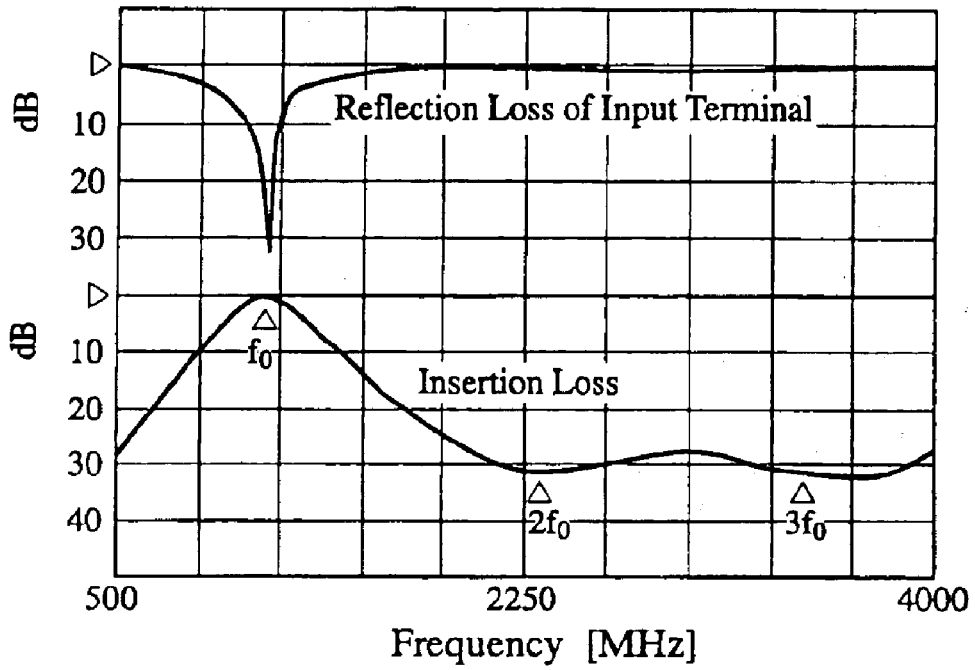
Fig. 4(a)(PRIOR ART)
FIG. 4(*a*) is a graph showing the frequency characteristics of the insertion loss of the conventional two-port isolator and the reflection loss of the input terminal.
Figure 4B:
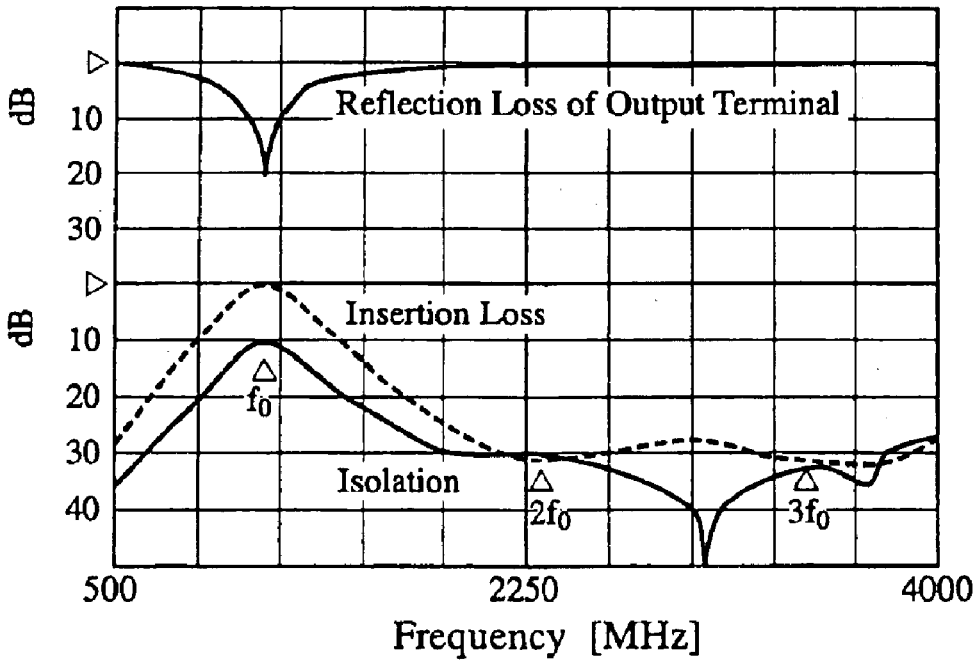
Fig. 4(b)(PRIOR ART)

However, because there are floating capacitance and parasitic inductance in the terminals (1), (2), it is rare that the outside circuit impedance of the isolator is just 50Ω. Accordingly, the outside circuit impedance should be determined for each isolator. In a practical isolator, as shown in FIGS. 3 and 4, even if the resistance of the resistor R were set at 50Ω, the isolation loss would not become infinite. In the case of FIGS. 3 and 4, the isolation loss is at most about 11 dB. This is because the outside circuit impedance of a portion to which the resistor R is connected is different from 50Ω. Thus, it is important to know how high the outside circuit impedance of this portion is.

As a result of intense research in view of the above, the inventors have found that it is possible to determine which is larger between the outside circuit impedance and the resistor, by changing a magnetic field applied to a main surface of a thin ferrite plate while measuring the isolation loss of the two-port isolator by a network analyzer, etc. In the case of the two-port isolator contained in a casing, too, a static magnetic field applied to the thin ferrite plate can be changed, for instance, by bringing a permanent magnet near it from outside.

When a static magnetic field applied to the thin ferrite plate increases, a center frequency at which the insertion loss is minimum moves toward the higher frequency side. On the contrary, when the static magnetic field is reduced, the center frequency moves toward the lower frequency side. At this time, the isolation loss is measured. The fact that the isolation loss increases when the static magnetic field is increased in a state where the resistor R of 50Ω is connected indicates that the outside circuit impedance to which the isolator is tuned is lower than 50Ω when no magnetic field is applied from outside. On the contrary, the fact that the isolation loss increases when a magnetic field is reduced indicates that the outside circuit impedance to which the isolator is tuned is higher than 50Ω when no magnetic field is applied from outside.

In the case of FIGS. 3 and 4, when a static magnetic field applied to the thin ferrite plate is reduced by bringing a magnet having an opposite polarity near to the thin ferrite plate from outside, the isolation loss increases. This means that the outside circuit impedance is higher than 50Ω when no magnet nears. As shown in FIG. 1(*b*), because the isolation is the maximum when the outside circuit impedance is equal to the resistance of the resistor R, it is desirable that the resistance of the resistor R is higher than 50Ω. Specifically, the isolation loss could be made 30 dB or more at a center frequency $f_0$ by setting the resistor R at about 70Ω. This means that the outside circuit impedance to which the isolator is tuned should be not 50Ω but 70Ω (see FIG. 2). Namely, in the example of FIGS. 3 and 4, the resistance of the resistor R is located on the left side (low resistance side) of the singular point of the isolation loss in FIG. 2(*a*). This is clear from the fact that the isolation loss has an attenuation peak near 2.5 $f_0$ in FIG. 4(*b*).

As described above, it is not preferable to set the resistor R at 50Ω in the two-port isolator of FIGS. 3 and 4, and the resistor R is preferably located on the right side of the singular point of the isolation (higher resistance side) on FIG. 2(*a*) to obtain large isolation loss in a wide bandwidth. Namely, it is preferable to use a resistor having resistance larger than the resistance at which the isolation loss is the maximum. To determine whether or not the resistance of the resistor R of an actual two-port isolator is located on the right side of the singular point of the isolation loss on FIG. 2(*a*), it is only necessary to observe whether or not the minimum value of the isolation loss increases, namely, whether or not the isolation loss increases, when a static magnetic field applied to the thin ferrite plate is increased, for instance, by bringing permanent magnet near to the thin ferrite plate from outside. As an example, if the isolation loss increases by at least 1 dB when a static magnetic field applied to the two-port isolator from outside is increased by 800 A/m or more, it can be confirmed that the resistor R has the desired resistance.

The above is true when the two-port isolator shown in FIG. 6 is operated above resonance. The "above resonance" means that an actual operation magnetic field $H_{act}$ is higher than a ferromagnetic resonance magnetic field $H_{res}$ at a center frequency $f_0$. If the demagnetizing field of the thin ferrite plate is neglected, there is a relation of $2\pi f_0=\gamma H_{res}$, wherein γ is a gyromagnetic ratio. A normalized operating magnetic field σ, which is usually within 1.5–3.0, is defined by the equation: $\sigma=H_{act}/H_{res}$.

Though the outside circuit impedance R is 70Ω in the example of FIGS. 3 and 4, the optimization of structure parameters could make the outside circuit impedance 50Ω. Also, there is actually only extremely small demand to make the isolation loss more than 20 dB, and the isolation loss of less than 10 dB makes the function of the isolator meaningless in an actual use. Accordingly, when the outside circuit impedance is 50Ω, it is determined from FIG. 2(*a*) that the desired lower limit of the resistance of the resistor R is 60Ω, and that its desired upper limit is 100Ω. Therefore, the desired range of the resistance of the resistor R is 60–100Ω.

As described above, the two-port isolator of the present invention can be provided with small input terminal reflection loss in a wide bandwidth by using a resistor R of 60–100Ω. This makes it possible to provide the two-port isolator with small insertion loss in a wide bandwidth. Also, when controlled to have the above desired resistance, as shown in FIG. 1(*c*), the isolation loss can be made 10 dB or more in as wide a frequency range as 0.8 $f_0$–3.0 $f_0$.

By observing that the isolation loss increases when a static magnetic field is increased by bringing a permanent magnet near to the isolator from outside according to the present invention, it is possible to confirm that the resistance of the resistor R is larger than the outside circuit impedance after assembling.

EXAMPLE 1

A two-port isolator having a circuit shown in FIG. 6 was produced. A thin ferrite plate G was constituted by garnet-type ferrite having an outer diameter of 2.2 mm and a thickness of 0.4 mm, both matching capacitors $C_1$, $C_2$ had capacitance of 2 pF, and a resistor R was 83Ω. This two-port isolator had a center frequency of 2.0 GHz and isolation loss of 10.0 dB.

Figure 5:
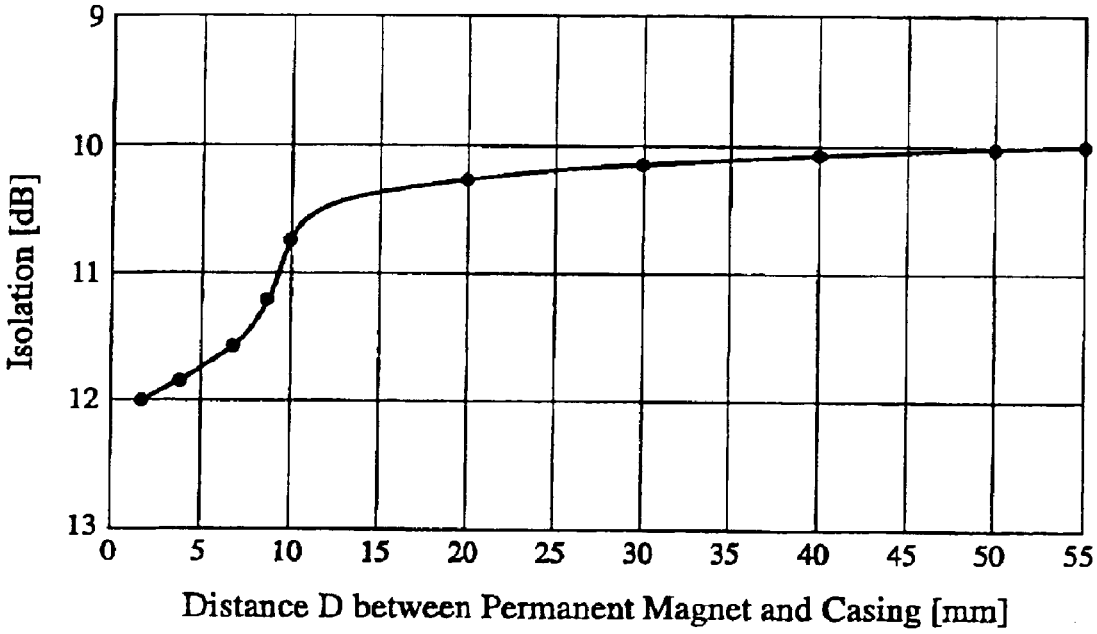
FIG. 5 is a graph showing the relation between the distance between a permanent magnet and a casing and isolation loss, when the permanent magnet near the casing serving as a magnetic yoke in the two-port isolator of the present invention.

A fully magnetized rare earth permanent magnet of 7 mm×7 mm×7 mm having a residual magnetic flux density of 1.1 T was brought near a casing of this two-port isolator from above, to increase a static magnetic field applied to the thin ferrite plate G. The relation between the isolation loss and the distance D between the permanent magnet and the casing is shown in FIG. 5. As is clear from FIG. 5, the isolation loss of the two-port isolator increased as the permanent magnet neared, and the isolation loss increased by 2 dB when the distance D became 2 mm. Because the sensitivity of increase in the isolation loss is influenced by the characteristics of the permanent magnet and the magnetic yoke design of the isolator, the resistor R can be regarded as having the desired resistance, if the isolation finally increases by 1 dB or more when a permanent magnet having a residual magnetic flux density of 0.5 T or more gradually nears from above to a point as close as 50 mm from the casing.

To increase a static magnetic field applied to the thin ferrite plate, for instance, the two-port isolator may be neared between the pole pieces of an electromagnet, instead of bringing a permanent magnet near the isolator from outside. Alternatively, the permanent magnet of the two-port isolator may be taken out, so that it is directly demagnetized or magnetized.

Figure 9A:
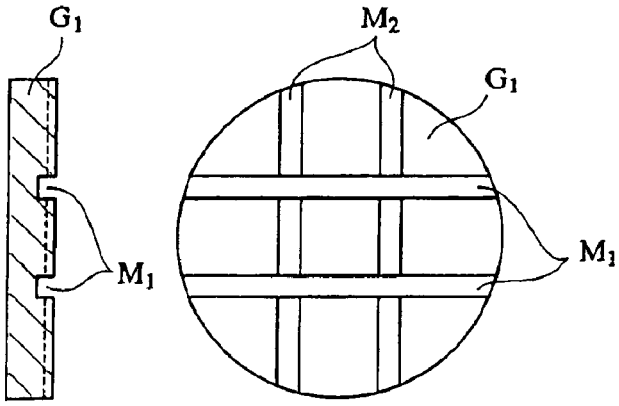
FIG. 9(*a*) is a plan view and a cross-sectional view showing the first thin ferrite plate piece according to one embodiment of the present invention.
Figure 9B:
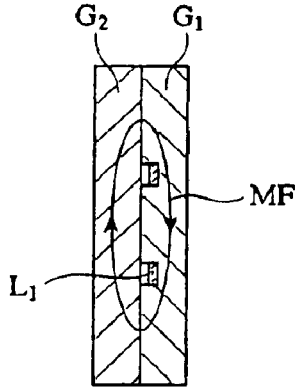

FIG. 9 shows a thin ferrite plate according to one embodiment of the present invention. As shown in FIG. 9(*a*), a thin ferrite plate piece $G_1$ is provided with grooves $M_1$ and $M_2$ for receiving the first and second central conductors $L_1$, $L_2$. Each groove $M_1$, $M_2$ has two grooves to receive central conductors $L_1$, $L_2$ each having parallel conductor portions. This makes it possible to efficiently couple a high-frequency magnetic field MF generated by the central conductors $L_1$, $L_2$ to the thin ferrite plate G. Because the central conductors $L_1$, $L_2$ are received in the grooves $M_1$, $M_2$, the two thin ferrite plate pieces $G_1$, $G_2$ are in close contact with each other in portions other than the grooves $M_1$, $M_2$, a demagnetizing field to a high-frequency magnetic field MF induced by the first central conductor $L_1$ is extremely small.

Why the conventional two-port isolator has a large insertion loss has been found to be due to the fact that the coupling of a first central conductor $L_1$ and a second central conductor $L_2$ is not complete. Because the central conductors $L_1$, $L_2$ are coupled via a thin ferrite plate, the poor coupling of the central conductors $L_1$, $L_2$ and the thin ferrite plate leads to large insertion loss in the two-port isolator. Accordingly, it is indispensable to improve the coupling of the central conductors $L_1$, $L_2$ to reduce insertion loss in a wide bandwidth.

Because the two central conductors $L_1$, $L_2$ received in the perpendicularly crossing grooves $M_1$, $M_2$ of the thin ferrite plate piece $G_1$ overlap each other in a center portion, the groove $M_1$ is slightly deeper than the groove $M_2$. The coupling of the thin ferrite plate G and the central conductors $L_1$, $L_2$ can be improved even with only one thin ferrite plate piece $G_1$ provided with grooves $M_1$, $M_2$ shown in FIG. 9(*a*). However, to improve the coupling effect further, the thin ferrite plate piece $G_1$ is preferably stacked with a thin ferrite plate piece $G_2$ without grooves to completely cover the central conductors $L_1$, $L_2$ with the thin ferrite plate piece $G_1$ as shown in FIG. 9(*b*). The two thin ferrite plate pieces $G_1$, $G_2$ are in close contact with each other in portions without grooves.

Figure 10A:
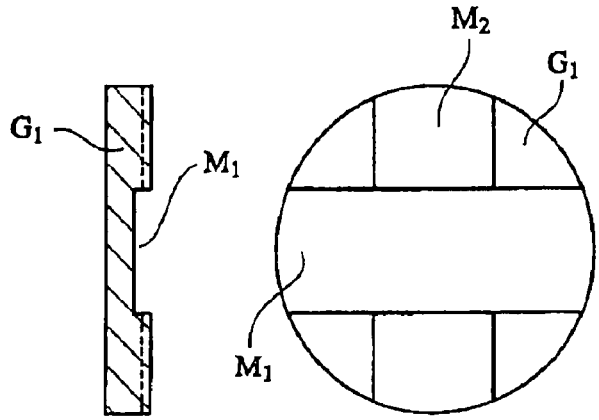
FIG. 10(*a*) is a plan view and a cross-sectional view showing the first thin ferrite plate piece according to another embodiment of the present invention.
Figure 10B:
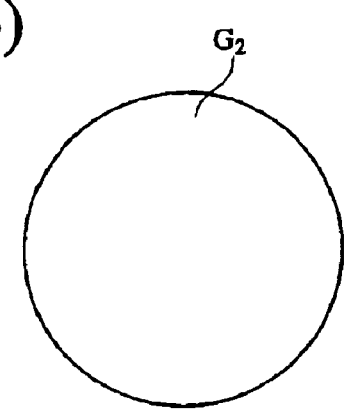
Figure 10C:
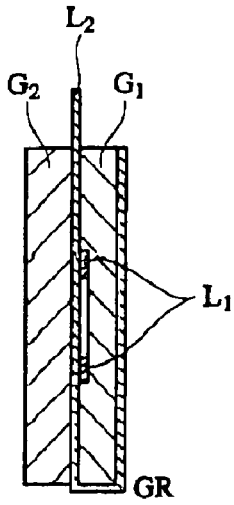

FIG. 10 shows a thin ferrite plate piece according to another embodiment of the present invention. FIG. 10(*a*) shows a first thin ferrite plate piece $G_1$ provided with grooves $M_1$, $M_2$ having width capable of receiving the overall central conductors $L_1$, $L_2$, and FIG. 10(*b*) shows a second thin ferrite plate piece $G_2$ without grooves. FIG. 10(*c*) shows an assembly having two central conductors $L_1$, $L_2$ between two thin ferrite plate pieces $G_1$, $G_2$.

Figure 11A:
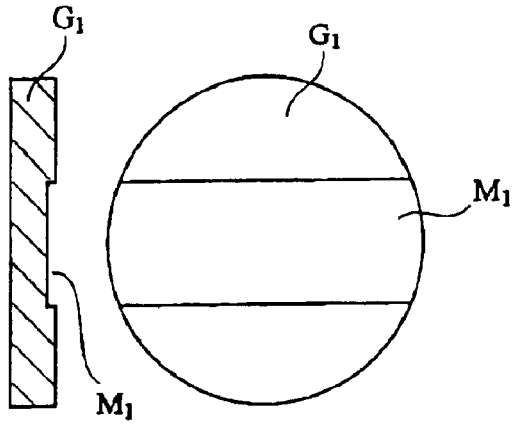
FIG. 11(*a*) is a plan view and a cross-sectional view showing the first thin ferrite plate piece according to a still further embodiment of the present invention.
Figure 11B:
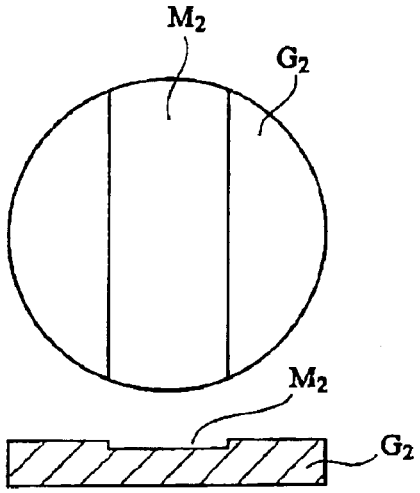
Figure 11C:
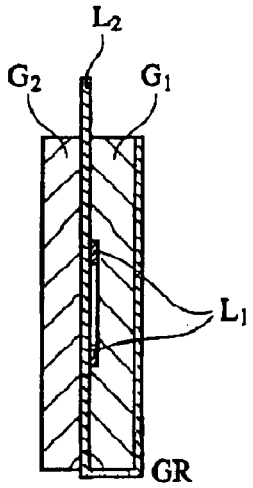

FIG. 11 shows a thin ferrite plate and central conductors according, to a still further embodiment of the present invention. FIG. 11(*a*) shows a first thin ferrite plate piece $G_1$ provided with a first groove $M_1$ having a width capable of receiving the overall first central conductor $L_1$, FIG. 11(*b*) shows a second thin ferrite plate piece $G_2$ provided with a second groove $M_2$ having a width capable of receiving the overall second central conductor $L_2$, and FIG. 11(*c*) shows an assembly having two central conductors $L_1$, $L_2$ between the two thin ferrite plate pieces $G_1$, $G_2$.

Figure 12A:
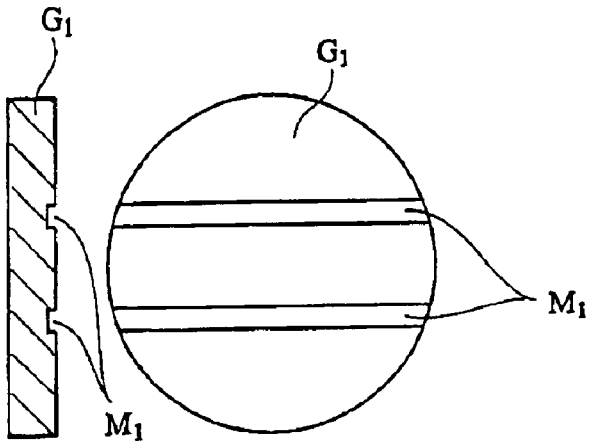
FIG. 12(*a*) is a plan view and a cross-sectional view showing the first thin ferrite plate piece according to a still further embodiment of the present invention.
Figure 12B:
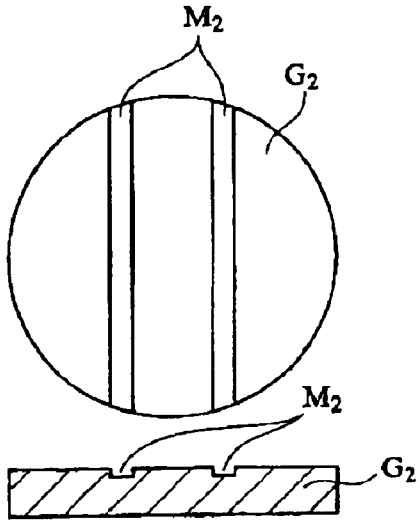
Figure 12C:
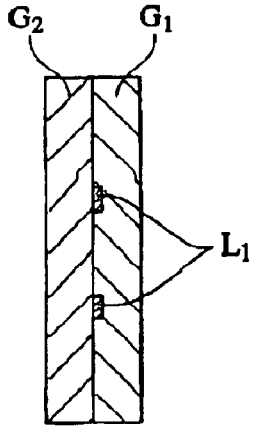

FIG. 12 shows a tin ferrite plate and central conductors according to a still further embodiment of the present invention. FIG. 12(*a*) shows a first thin ferrite plate piece $G_1$ provided with a first groove $M_1$ for receiving two conductor portions of the first central conductor $L_1$, FIG. 12(*b*) shows a second thin ferrite plate piece $G_2$ provided with a second groove $M_2$ for receiving two conductor portions of the second central conductor $L_2$, and FIG. 12(*c*) shows an assembly having two central conductors $L_1$, $L_2$ between the two thin ferrite plate pieces $G_1$, $G_2$.

Figure 13A:
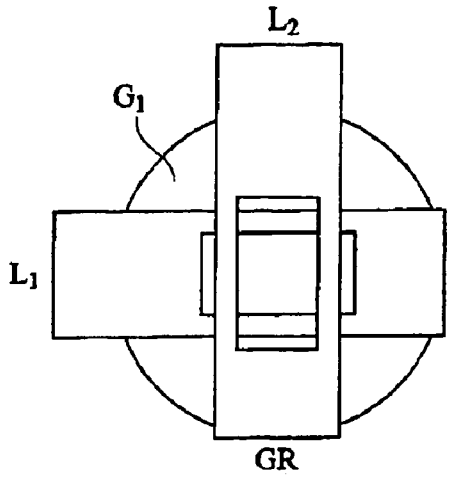
FIG. 13(*a*) is a plan view showing a combination of a first thin ferrite plate piece and two central conductors according to a still further embodiment of the present invention.
Figure 13B:
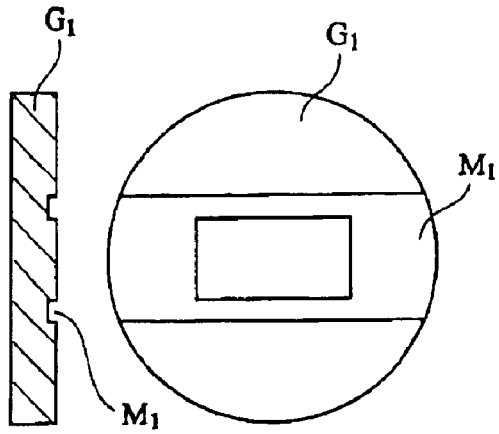

FIG. 13 shows a thin ferrite plate and central conductors according to a still further embodiment of the present invention. FIG. 13(*a*) shows a first thin ferrite plate piece $G_1$ having a groove $M_1$ such that two central conductors $L_1$, $L_2$ can cross each other in two parallel conductor portions, FIG. 13(*b*) shows a first thin ferrite plate piece $G_1$ having a projection only in a portion corresponding to the center portions of the central conductors $L_1$, $L_2$. A second thin ferrite plate piece $G_2$ (not shown) has a groove $M_2$ having the same shape as the groove $M_1$, which perpendicularly crosses the groove $M_1$ of the first thin ferrite plate piece $G_1$.

Figure 14A:
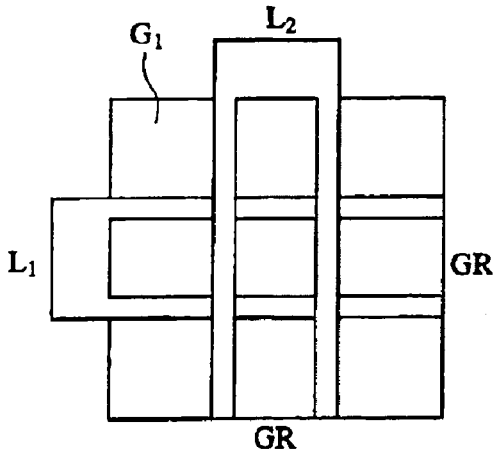
FIG. 14(*a*) is a plan view showing a combination of a first thin ferrite plate piece and two central conductors according to a still further embodiment of the present invention.
Figure 14B:
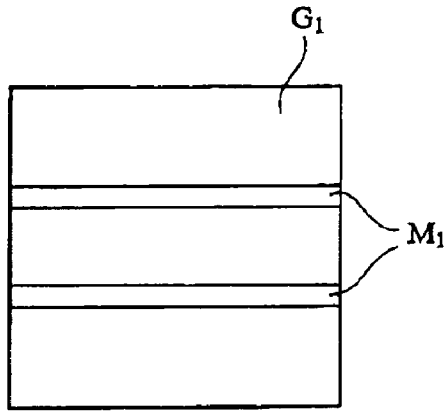

FIGS. 14(*a*) and (*b*) show a thin, rectangular ferrite plate and central conductors according to a still further embodiment of the present invention. This embodiment is the same as that shown in FIG. 12 except for the shape of the thin ferrite plate.

Figure 15:
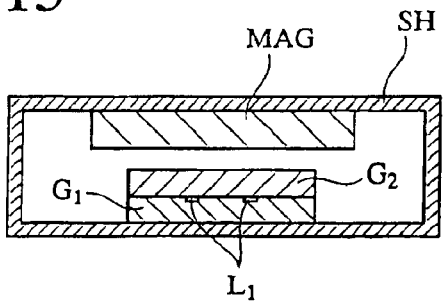
FIG. 15 is a cross-sectional view showing the magnetic circuit of the two-port isolator of the present invention.

FIG. 15 shows a magnetic circuit according to a still further embodiment of the present invention. Two thin ferrite plate pieces $G_1$, $G_2$ are contained in a casing SH serving as a magnetic yoke having an inner surface, to which a permanent magnet MAG is fixed. The first thin ferrite plate piece $G_1$ is disposed on the lower side, and the second thin ferrite plate piece $G_2$ is disposed on the side of the permanent magnet MAG. To improve the coupling of the central conductors $L_1$, $L_2$, a static magnetic field should be uniform in the thin ferrite plate. Because the magnetic circuit of FIG. 15 has one permanent magnet MAG, a stronger magnetic field acts on the second thin ferrite plate piece $G_2$ near the permanent magnet MAG, and a relatively weak magnetic field acts on the first thin ferrite plate piece $G_1$. To achieve the effects of the present invention, it is desired to reduce the non-uniformity of the magnetic field. Effective as a method for reducing the non-uniformity of the magnetic field is to make the saturation magnetization of the second thin ferrite plate piece $G_2$ larger than that of the first thin ferrite plate piece $G_1$.

With respect to the two-port isolator shown in FIG. 15, the insertion loss was determined by simulation, when thin ferrite plate pieces $G_1$, $G_2$ both having a saturation magnetization of 0.09 T were used, and when the saturation magnetization of the thin ferrite plate piece $G_2$ was changed to four kinds, 0.095 T, 0.1 T, 0.11 T, and 0.12 T. As a result, it was found that when the thin ferrite plate piece $G_2$ had a saturation magnetization of 0.095 T, 0.1 T and 0.11 T, respectively, the insertion loss was small. When the saturation magnetization of the thin ferrite plate piece $G_2$ was as large as 0.12 T, the insertion loss rather increased. This appears to be due to the fact that a magnetic field in the second thin ferrite plate piece $G_2$ becomes smaller, resulting in increase in magnetic loss. The difference in a saturation magnetization between the two thin ferrite plate pieces is preferably in a range of 0.005 T–0.02 T.

The dotted lines in FIG. 3(*a*) and (*b*) show the insertion loss, isolation loss and reflection loss of a two-port isolator comprising two thin ferrite plate pieces having grooves in FIG. 12. The minimum value of insertion loss decreased to about 0.40 dB at a frequency of 1140 MHz (center frequency $f_0$). This insertion loss is comparable to that of the three-port circulator. The isolation loss was about 14 dB at a center frequency $f_0$, with slight improvement appreciated. Also, the bandwidth of the reflection loss of the input terminal was nearly doubled.

Figure 18A:
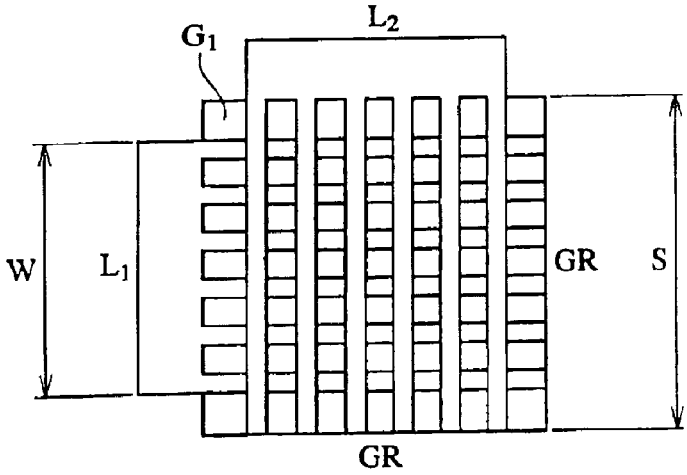
FIG. 18(*a*) is a plan view showing a combination of a central conductor having six conductor portions and a first thin ferrite plate piece.
Figure 18B:
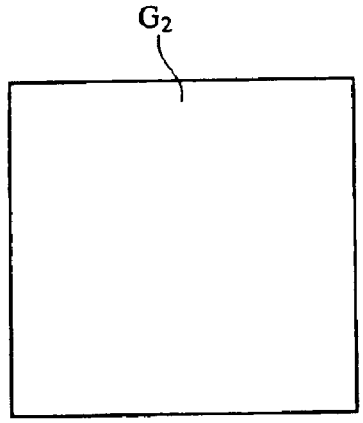

FIG. 18 shows a combination of a thin ferrite plate and central conductors according to one embodiment of the present invention. As shown in FIG. 18(*a*), a first central conductor $L_1$ having six parallel conductor portions is disposed on a first rectangular, thin ferrite plate piece $G_1$, and a second central conductor $L_2$ having six parallel conductor portions is substantially perpendicularly disposed on the first central conductor $L_1$ in close contact. FIG. 18(*b*) shows a second thin ferrite plate piece $G_2$ disposed on the second central conductor $L_2$ having six parallel conductor portions in close contact.

Because the central conductors each having six parallel conductor portions are used in this embodiment, a high-frequency magnetic field generated by electric current flowing through the first central conductor is uniformly applied to the first and second thin ferrite plate pieces $G_1$, $G_2$ entirely, whereby energy is transmitted to the second central conductor having six parallel conductor portions efficiently via the thin ferrite plate pieces $G_1$, $G_2$. This effect is obtained because the thin ferrite plate is rectangular. Because of improved coupling between the first and second central conductors $L_1$, $L_2$, the insertion loss is reduced in a wide bandwidth.

Figure 16A:
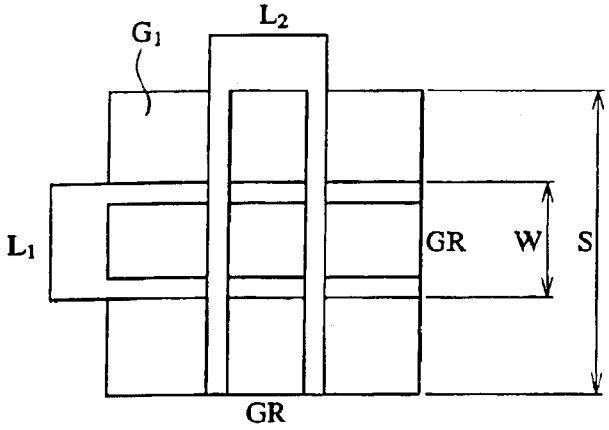
Fig. 16(a) (PRIOR ART)
FIG. 16(*a*) is a plan view showing a combination of a first, rectangular, thin ferrite plate piece and a central conductor.
Figure 16B:
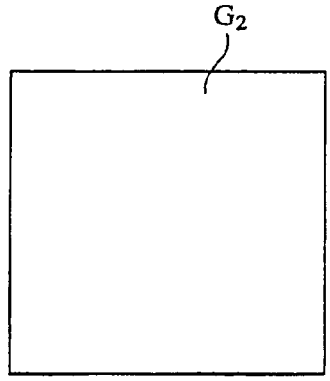
Fig. 16(b) (PRIOR ART)
Figure 17:
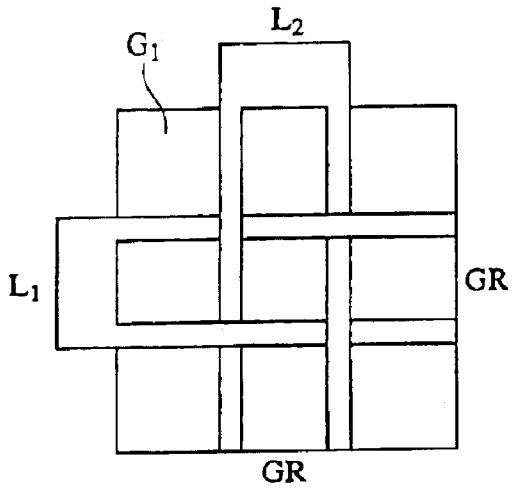
Fig. 17(PRIOR ART)
FIG. 17 is a plan view showing a combination of a first, rectangular, thin ferrite plate piece and a central conductor.

In the central conductor having two parallel conductor portions shown in FIG. 16, only a center portion of the rectangular, thin ferrite plate is excited at a high frequency, resulting in concentration of coupling of the two central conductors in their center portions. On the contrary, in the central conductor of the present invention having six parallel conductor portions shown in FIG. 18, high-frequency excitation occurs even in a peripheral portion of the thin ferrite plate, whereby the coupling of the first and second central conductors $L_1$, $L_2$ occurs entirely in the rectangular, thin ferrite plate. With respect to a ratio W/S of the width W of the central conductor $L_1$ to the a distance S between the parallel opposing sides of the rectangular, thin ferrite plate, W/S can be increased to ½ or more in the central conductor of the present invention having six parallel conductor portions, though W/S is ⅓–⅖ in the conventional central conductor having two parallel conductor portions. In the example of FIG. 18, W/S is substantially 0.9. The simulation results indicate that W/S is preferably ½ or more. Also, to obtain W/S of ½ or more, each central conductor preferably has three or more conductor portions.

Figure 19:
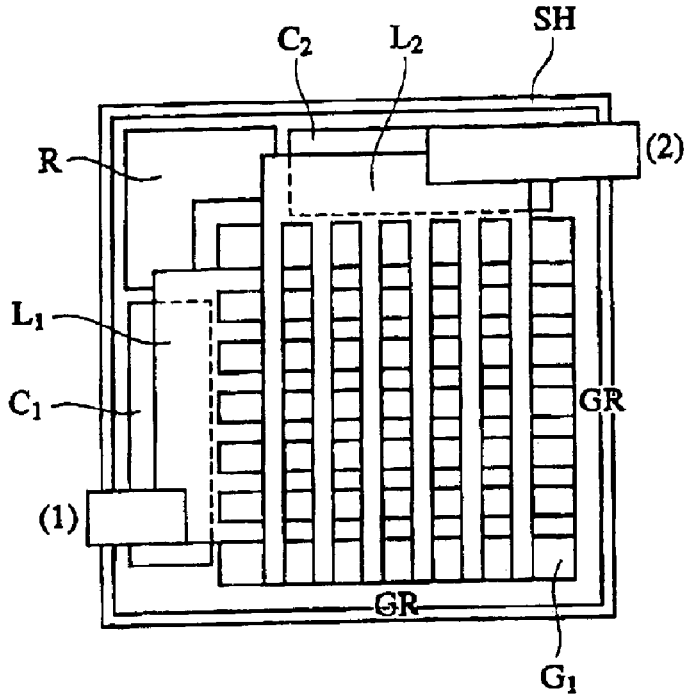
FIG. 19 is a plan view showing the internal structure of the two-port isolator of the present invention.

FIG. 19 shows a rectangular casing SH containing a thin ferrite plate, two central conductors $L_1$, $L_2$, a resistor R, and matching capacitors $C_1$, $C_2$ according to a still further embodiment of the present invention. A rectangular, thin ferrite plate piece $G_1$ is disposed in the rectangular casing SH slightly near one corner thereof. This provides space in diagonally opposing corners of the casing, where a resistor R and matching capacitors $C_1$, $C_2$ are disposed. A long side of the rectangular, matching capacitor is close to each side of the thin ferrite plate in parallel. As is clear from FIG. 19, extremely efficient mounting can be achieved with high occupancy.

Figure 20:
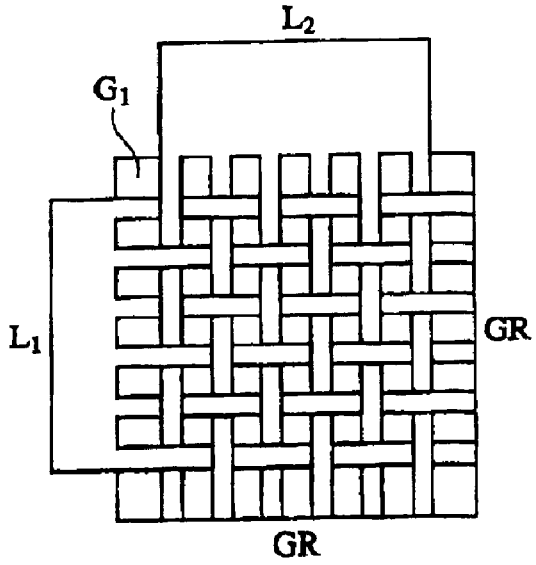
FIG. 20 is a plan view showing a combination of first and second central conductors each having six conductor portions and a first thin ferrite plate piece according to a still further embodiment of the present invention.

FIG. 20 shows a combination of a thin ferrite plate and central conductors according to a still further embodiment of the present invention. In this embodiment, conductor portions of the two central conductors $L_1$, $L_2$ are knitted to provide strong coupling therebetween.

Figure 21:
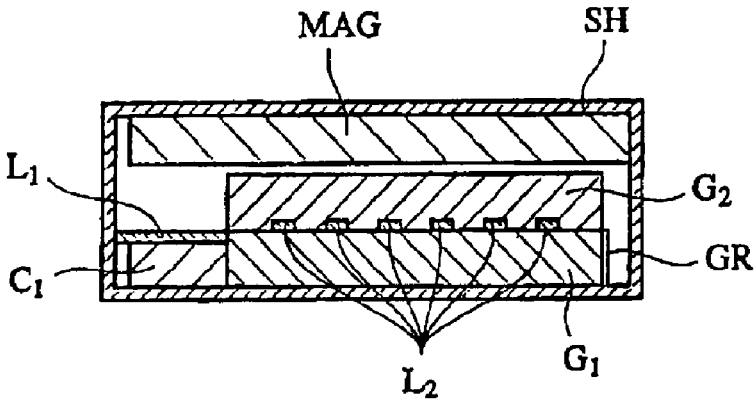
FIG. 21 is a cross-sectional view showing the internal structure of the two-port isolator of the present invention.

FIG. 21 shows a cross section of the two-port isolator of FIG. 18, in which central conductors are incorporated. The first thin ferrite plate piece $G_1$ is disposed on the lower side of a casing SH, and the second thin ferrite plate piece $G_2$ is disposed on the side of a permanent magnet MAG. To improve the coupling of central conductors $L_1$, $L_2$ having six parallel conductor portions, it is necessary to keep a static magnetic field in the thin ferrite plate uniform. Because the magnetic circuit of FIG. 21 comprises one permanent magnet, the second thin ferrite plate piece $G_2$ near the permanent magnet is exposed to a stronger static magnetic field, while the first thin ferrite plate piece $G_1$ is in a weaker static magnetic field. It has been found that what is necessary to eliminate this non-uniformity is to make the saturation magnetization of the second thin ferrite plate piece $G_2$ larger than the saturation magnetization of the first thin ferrite plate piece $G_1$. Because the second thin ferrite plate piece $G_2$ near the permanent magnet MAG has a larger saturation magnetization and thus a larger demagnetizing field, its internal magnetic field is strongly reduced under a strong external magnetic field near the permanent magnet MAG. On the other hand, the first thin ferrite plate piece $G_1$ has a relatively small demagnetizing field due to the relatively small saturation magnetization and so its internal magnetic field is less reduced under a relatively week external field remote from the permanent magnet MAG. As a result, a static internal magnetic field is made uniform between the first and second thin ferrite plate pieces $G_1$, $G_2$.

Figure 22A:
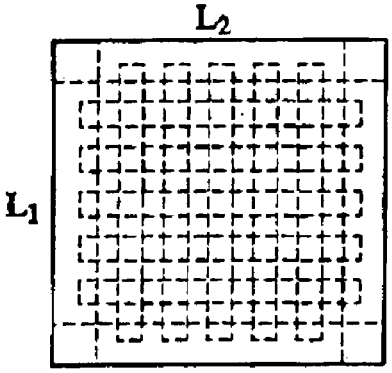
FIG. 22(*a*) is a plan view showing a thin ferrite plate in which central conductors are integrally laminated.
Figure 22B:
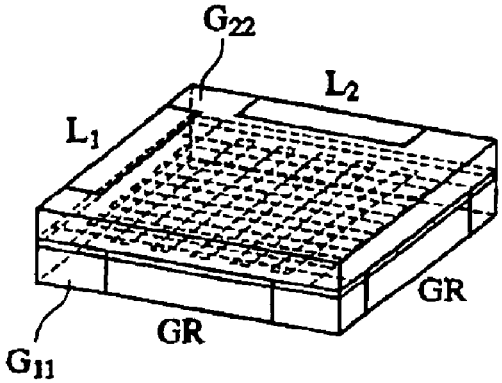

FIG. 22 shows an assembly formed by attaching first and second central conductors to a plurality of ferrite sheets, laminating and sintering the ferrite sheets according to a still further embodiment of the present invention. Each central conductor is shown by a dotted line. Ends of the first and second central conductors $L_1$, $L_2$ connected to input-output terminals are exposed on the upper surface of the thin ferrite plate as surface electrodes. Terminals GR of the first and second central conductors $L_1$, $L_2$ connected to a ground are exposed on the lower surface of the thin ferrite plate.

Figure 23:
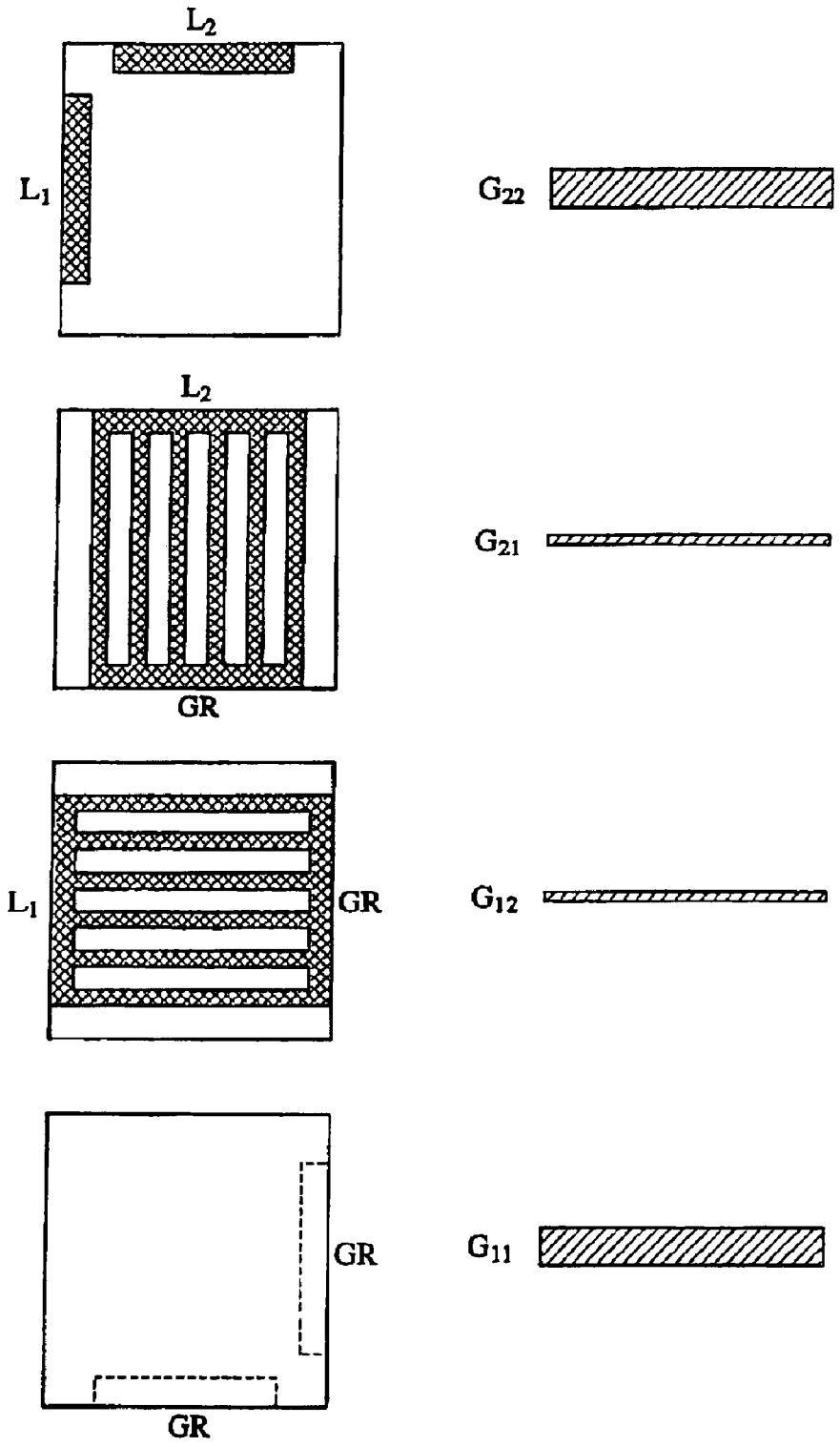
FIG. 23 is a development view showing the thin ferrite plate of FIG. 22.

FIG. 23 is a development view of the thin ferrite plate of FIG. 22. A lowermost ferrite green sheet $G_{11}$ is relatively thick with a ground electrode GR printed on its rear surface. Laminated thereon is a relatively thin ferrite green sheet $G_{12}$ with the first central conductor $L_1$ printed on its surface. Laminated thereon is a relatively thin ferrite green sheet $G_{21}$ with the second central conductor $L_2$ printed on its surface in perpendicular to the first central conductor $L_1$. An uppermost ferrite green sheet $G_{22}$ is relatively thick with external electrodes $L_{11}$, $L_{21}$ to be connected to input-output terminals printed on its surface. Each ferrite green sheet $G_{11}$, $G_{12}$, $G_{21}$, $G_{22}$ is composed of ferrite powder solidified with a binder. After pressing a laminate of four sheets, it is sintered at a high temperature to obtain a thin ferrite plate in which the first and second central conductors are embedded. Incidentally, with the sheet $G_{22}$ close to the permanent magnet set to have a large saturation magnetization, the static magnetic field can effectively be made uniform.

Figure 27:
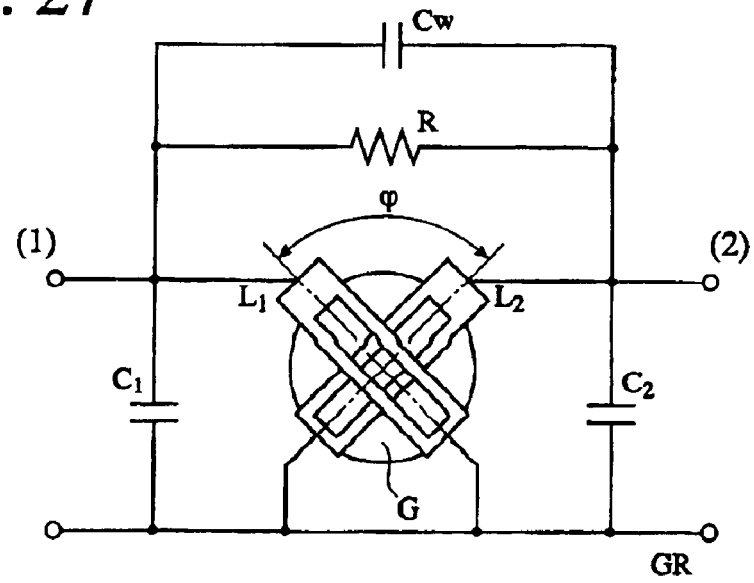
FIG. 27 is a view showing another example of the equivalent circuit of the two-port isolator, to which the present invention is applicable.

FIG. 27 shows an equivalent circuit of the two-port isolator of the present invention. What is different from the two-port isolator shown in FIG. 6 is that the crossing angle $\phi$ of the first and second central conductors is deviated from 90°, and that to compensate the effect of the crossing angle $\phi$, a third capacitor Cw is connected in parallel with the resistor R.

Figure 24A:
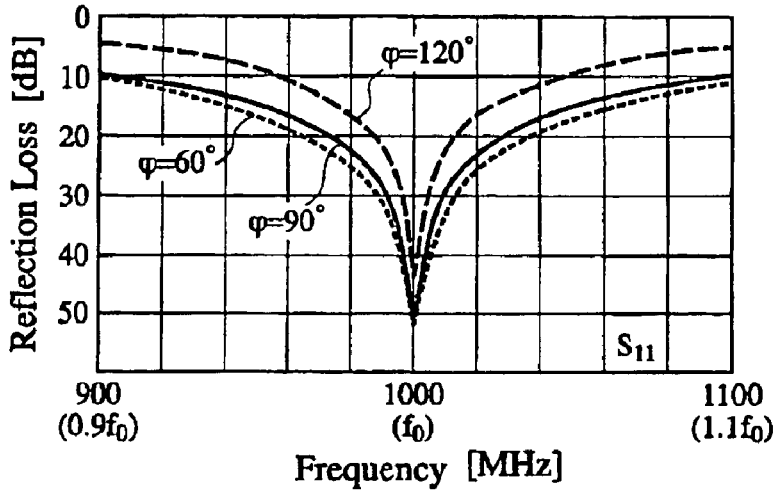
FIG. 24(*a*) is a graph showing the frequency characteristics of the reflection loss of the two-port isolator.
Figure 24B:
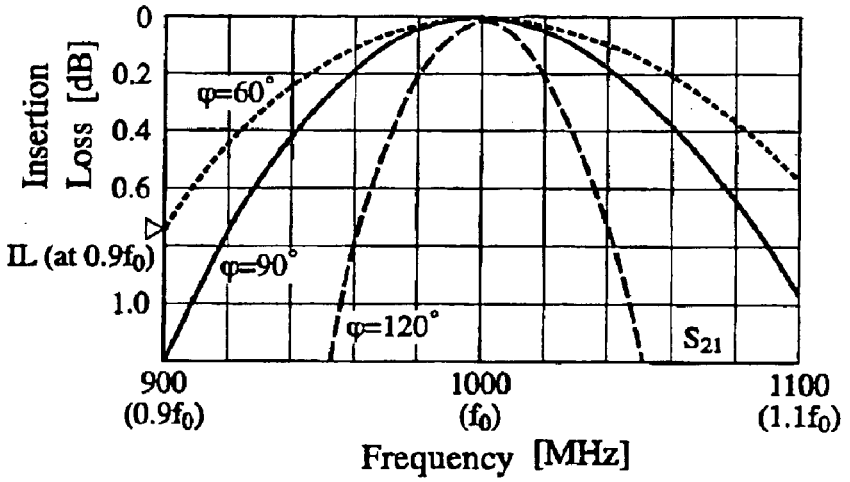
Figure 24C:
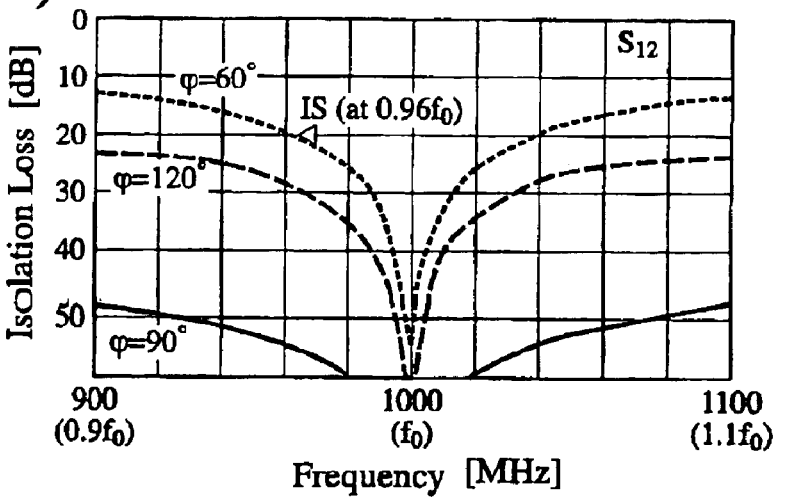

FIGS. 24(*a*), (*b*), (*c*) show the frequency characteristics of S parameters of a two-port isolator calculated by using the equivalent circuit of FIG. 27 in a frequency range of a center frequency $f_0$ of 1000 MHz±10% (900 MHz–1100 MHz). In FIG. 27, it is assumed that the two central conductors $L_1$, $L_2$ are completely coupled. Used parameters are characteristic impedance Zo of 50Ω, air-core inductance K of 1 nH, and a saturation magnetization 4πMs of the thin ferrite plate of 900 G, when the resistor R has a resistance of 50Ω. FIG. 24 shows calculation results at three typical angles $\phi$ of 60°, 90° and 120°.

The third capacitor Cw was 0 at $\phi$=90°, 7.85 pF at $\phi$=60°, and −7.85 pF at $\phi$=120°. For Cw to be minus means that it acts not as a capacitor but as an inductor.

FIG. 24(*a*) shows the frequency characteristics of reflection loss $S_{11}$. With $\phi$=90° as a reference, the reflection loss $S_{11}$ has a wide bandwidth when $\phi$ is smaller than 90°, and the bandwidth rapidly narrows when $\phi$ becomes larger than 90°. FIG. 24(*b*) also shows the frequency characteristics of insertion loss $S_{21}$. With $\phi$=90° as a reference, the bandwidth of $S_{21}$ is wide when $\phi$ is smaller than 90°, and the bandwidth of $S_{21}$ rapidly narrows when $\phi$ exceeds 90°. The insertion loss $S_{21}$ at 900 MHz is indicated by a white triangle as IL (at $0.9f_0$) because it is related to the bandwidth of insertion loss. Small IL means that the bandwidth of insertion loss is wide. It is clear from the results of FIGS. 24(*a*), (*b*) that the bandwidth of reflection loss and insertion loss is wide at $\phi$=60°.

FIG. 24(*c*) shows the frequency characteristics of isolation loss $S_{12}$ calculated under the same conditions. Though as high isolation loss as 45 dB or more is obtained at $\phi$=90° in a frequency range 0.9 $f_0$–1.1 $f_0$ (900 MHz–1100 MHz), the isolation loss is deteriorated regardless of whether $\phi$ becomes larger or smaller than 90°. Particularly when $\phi$ is smaller than 90°, the deterioration of the isolation loss is remarkable. The isolation loss in a bandwidth of 0.96 $f_0$ (960 MHz) called IS (at $0.96f_0$) is indicated by a white triangle. Large IS means that the bandwidth of isolation loss is wide.

Figure 25:
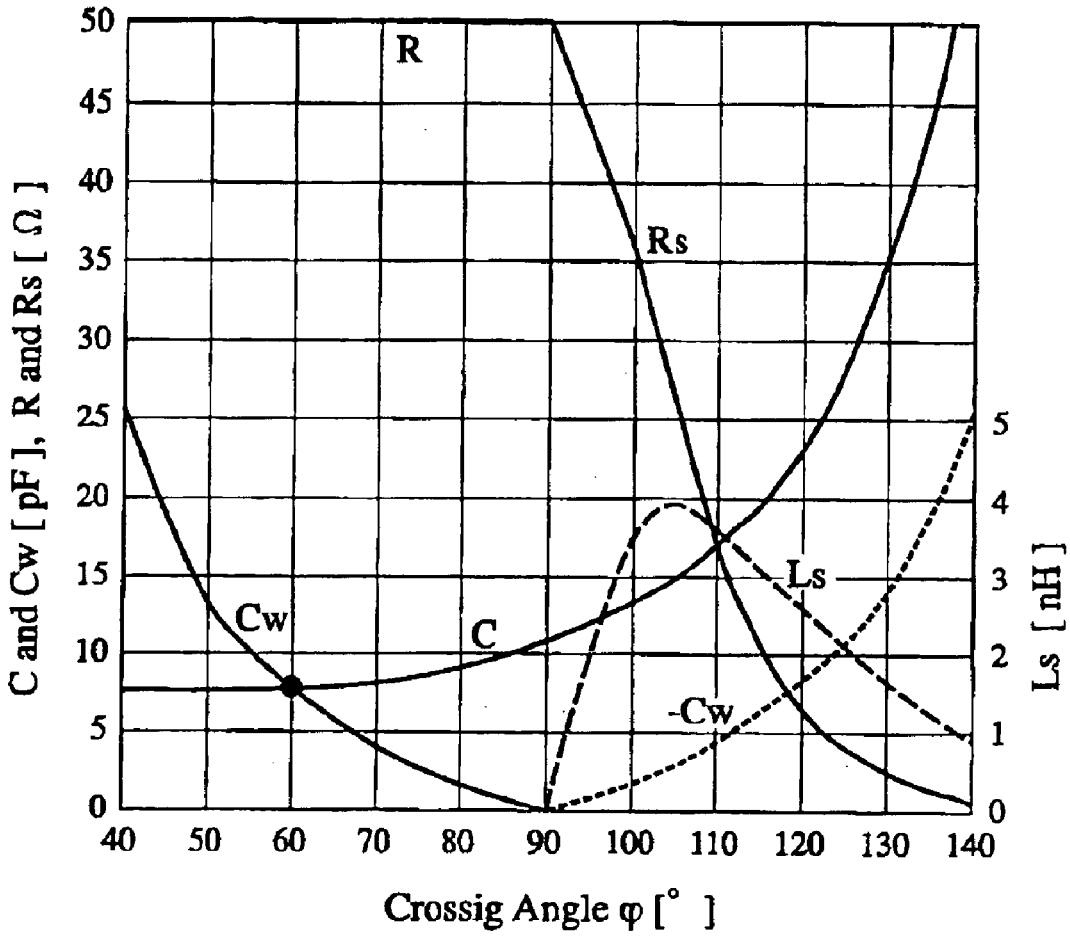
FIG. 25 is a graph showing the relation between each parameter of the two-port isolator and the crossing angle of the two central conductors.

FIG. 25 shows the variation of each parameter when the crossing angle $\phi$ of the two central conductors changes in a wider range of 40°–140°. The first matching capacitor $C_2$ and the second matching capacitor $C_2$ have the same capacitance. When $\phi$ is smaller than 90°, the third capacitor Cw slowly increases, and becomes equal to the first and second matching capacitors C at $\phi$=60°, both being 7.85 pF.

Figure 28:
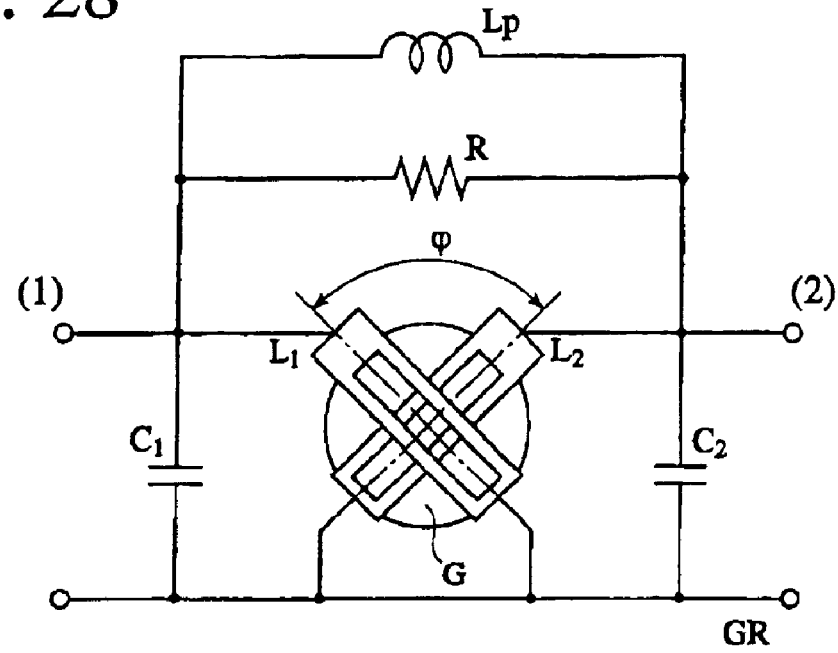
FIG. 28 is a view showing a still further example of the equivalent circuit of the two-port isolator, to which the present invention is applicable.

When $\phi$ becomes larger than 90°, the capacitance of the first and second matching capacitors C rapidly increases, though the third capacitor Cw becomes minus with its absolute value rapidly increasing. Minus Cw is indicated by a dotted line. The curve of the absolute value of Cw is laterally symmetric with $\phi$=90° as a center. Because a capacitor having minus capacitance is equivalently identical to an inductor Lp, its equivalent circuit is shown in FIG. 28.

Figure 29:
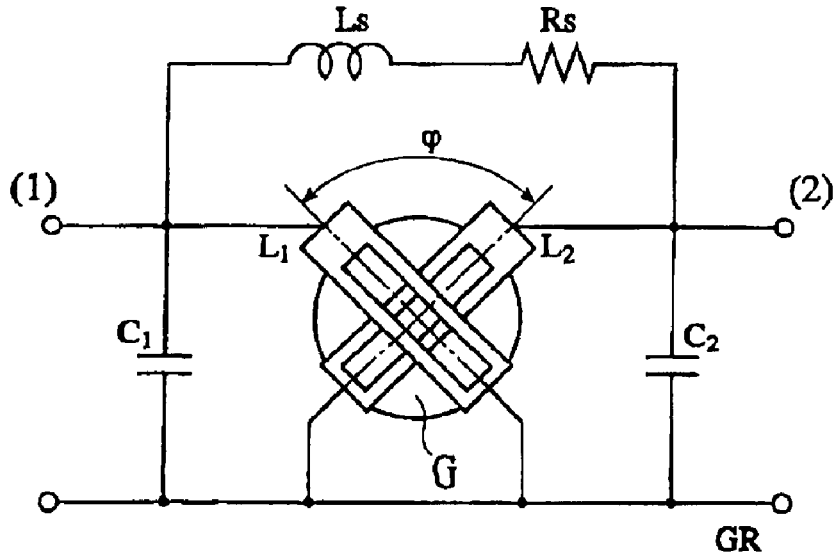
FIG. 29 is a view showing a still further example of the equivalent circuit of the two-port isolator, to which the present invention is applicable.

When $\phi$ is larger than 90°, an inductor Lp in parallel with the resistor R is needed, but this equivalent circuit is not practical. This is because Lp is infinite at $\phi$=90°, though around 90° is important for practical purpose. Practical to avoid this problem is a circuit in which an inductor Ls is inserted in series to the resistor Rs as shown in FIG. 29, because when $\phi$ decreases to 90°, Ls becomes asymptotic to 0 nH, and Rs to 50Ω.

FIG. 25 shows the changes of Ls and Rs at $\phi$>90° in the right half thereof. As $\phi$ becomes large, Rs rapidly approaches to zero, while Ls becomes maximum at 105°. When $\phi$ is larger than it, Ls decreases monotonously.

Figure 26:
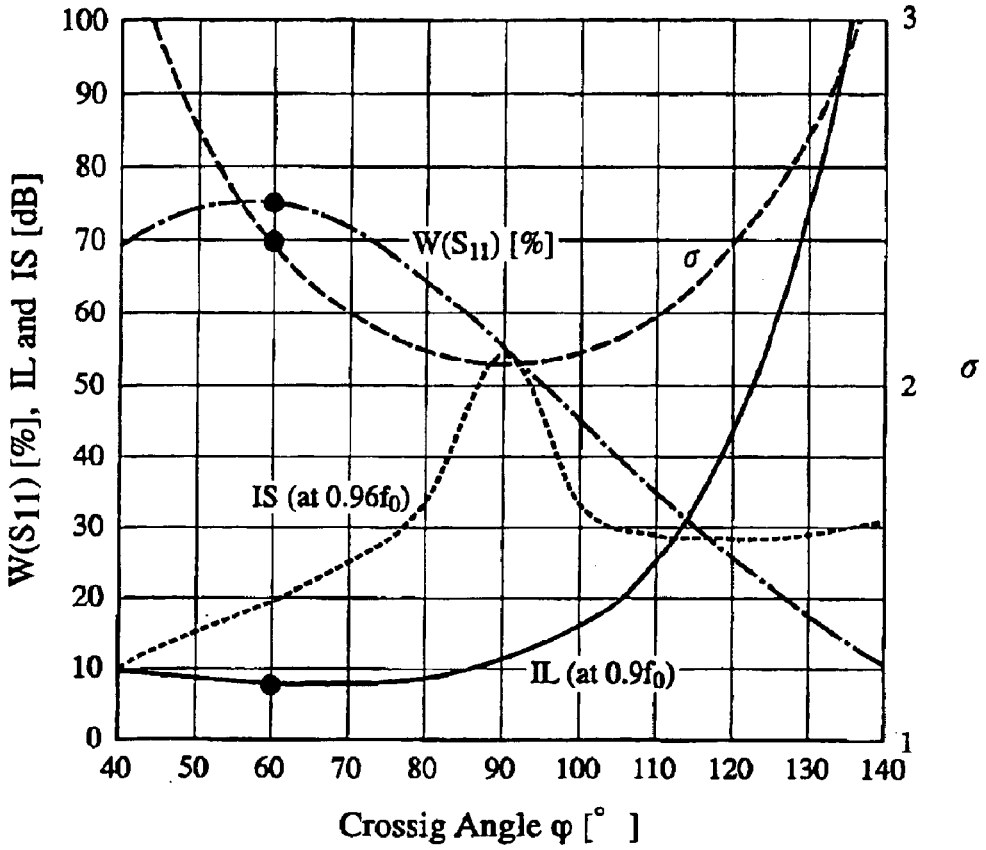
FIG. 26 is a graph showing the relation between the characteristics of the two-port isolator and the crossing angle of the two central conductors.

FIG. 26 shows the dependency of the characteristic parameters of isolator on angle calculated under the above conditions. The bandwidth of insertion loss $S_{21}$ indicated by IL (at 0.9 $f_0$) decreases as $\phi$ becomes smaller than 90°, and becomes minimum at $\phi$ of 60°, while it rapidly increases when $\phi$ becomes larger than 90°.

A normalized operating magnetic field $\sigma$ indicating the intensity of a static magnetic field becomes minimum at $\phi$=90°. The normalized operating magnetic field $\sigma$ is an internal magnetic field $H_{act}$ in the thin ferrite plate divided by a ferromagnetic resonance magnetic field $H_{res}$ ($=2\pi f_0/\gamma$) at a center frequency $f_0$, expressed by a number with no dimension. $\gamma$ is a constant called a gyromagnetic ratio.

The bandwidth W ($S_{11}$) at which the reflection loss $S_{11}$ lowers to 20 dB increases as $\phi$ decreases, and reaches the maximum of 7.6% at $\phi$ of about 60°. When $\phi$ becomes larger than 90°, the W ($S_{11}$) decreases monotonously.

The IS (at 0.96 $f_0$) indicating the bandwidth of isolation loss is maximum, 55 dB at $\phi$=90°. Particularly, it monotonously decreases at $\phi$<90°, and becomes 10 dB at $\phi$=40°. Though IS decreases at $\phi$>90°, it still exhibits high attenuation of about 30 dB.

The followings are derived from the results of FIGS. 26 and 27:

(1) When low insertion loss is important, the range of $\phi$<90° is desired;

(2) When stress is placed on isolation, $\phi$=90° is desired;

(3) The bandwidth of insertion loss and the bandwidth of reflection loss are widest at $\phi$ of about 60°; and (4) IS (at 0.96 $f_0$) becomes lower than a practically acceptable level of 10 dB, when $\phi$ becomes less than 40°.

As described above, the bandwidth of insertion loss is extremely wide, and the isolation loss is sufficiently acceptable for practical purposes at $\phi$=60°. Though this effect is appreciated at $\phi$=40°, at which IS (at 0.96 $f_0$) is 10 dB, $\phi$ of smaller than 40° makes IS (at 0.96 $f_0$) too small to be accepted for practical purposes. Accordingly, the lower limit of $\phi$ is preferably 40°. Also, the bandwidth of insertion loss IL (at 0.9 $f_0$) and the bandwidth of reflection loss W ($S_{11}$) are considerably improved at $\phi$=80° than at $\phi$=90°. However, when $\phi$ becomes larger than 80°, IS (at 0.96 $f_0$) increases too much. Accordingly, the upper limit of $\phi$ is preferably 80°.

Though there is a third capacitor Cw in the equivalent circuit shown in FIG. 27, Cw should be considerably larger than C at a crossing angle $\phi$ of 40° between the first and second central conductors, and Cw may be considerably small at $\phi$ of 80°. In some cases, Cw may be unnecessary, because there is capacitance between both central conductors $L_1$, $L_2$ due to the fact that two central conductors $L_1$, $L_2$ crossing substantially in a center portion of the thin ferrite plate G are electrically insulated from each other with a thin insulating sheet, this capacitance functioning like Cw in FIG. 27 as an equivalent circuit. Therefore, with this inter-conductor capacitance properly set, the third capacitor Cw may be omitted. Also, with this inter-conductor capacitance, the third capacitor Cw may often practically be smaller than the first and second capacitors C.

When the inter-conductor capacitance is too much, exceeding the total amount of Cw necessary for compensating the effect of the crossing angle $\phi$, an inductor Lp may be connected in parallel with the resistor R to compensate this excess. The circuit of the resistor R and the inductor Lp may be replaced by the resistor Rs and the inductor Ls connected in series thereto.

As described above, with the resistance of the resistor connected between the first input-output terminal and the second input-output terminal set at the desired level larger than the outside circuit impedance, it is possible to obtain small insertion loss and large isolation in a wide bandwidth of a high-frequency signal. Also, by bringing a magnet near the isolator from outside, it is possible to evaluate whether or not the resistor of the two-port isolator has the desired resistance without difficulty.

With the thin ferrite plate provided with grooves for receiving part of central conductors, the coupling of the first central conductor and the second central conductor can be increased, thereby obtaining low insertion loss in a wide frequency bandwidth.

Further, by using a rectangular, thin ferrite plate, and first and second central conductors each having three or more conductor portions, and by disposing the first and second central conductors in parallel with the side of the rectangular, thin ferrite plate, the two-port isolator can be provided with small insertion loss in a wide bandwidth of a high-frequency signal.

Further, by setting the crossing angle of the first central conductor and the second central conductor at 40–80°, the two-port isolator can be provided with small insertion loss in a wide bandwidth of a high-frequency signal.

What is claimed is:

1. A two-port isolator comprising a thin ferrite plate, a permanent magnet for applying a static magnetic field to said thin ferrite plate, first and second central conductors disposed substantially in a center portion of said thin ferrite plate and crossing each other with electric insulation, first and second input-output terminals each connected to an end of each of said first and second central conductors, a common terminal connected to the other ends of said first and second central conductors, a first matching capacitor connected between said first input-output terminal and said common terminal, a second matching capacitor connected between said second input-output terminal and said common terminal, and a resistor connected between said first input-output terminal and said second input-output terminal, wherein a crossing angle (on the resistor side) of the center axis of said first central conductor and the center axis of said second central conductor is in a range of 40–80°, wherein a third capacitor is connected in parrallel with said resistor and said common terminal is connected to a ground, and wherein said third capacitor has smaller static capacitance than those of said first and second matching capacitors.

2. The two-port isolator according to claim 1, wherein an inductor is connected in parallel with or in series to said resistor.

3. A two-port isolator comprising a thin ferrite plate, a permanent magnet for applying a static magnetic field to said thin ferrite plate, first and second central conductors disposed substantially in a center portion of said thin ferrite plate and crossing each other with electric insulation, first and second input-output terminals each connected to an end of each of said first and second central conductors, a common terminal connected to the other ends of said first and second central conductors, a first matching capacitor connected between said first input-output terminal and said common terminal, a second matching capacitor connected between said second input-output terminal and said common terminal, and a resistor connected between said first input-output terminal and said second input-output terminal, wherein the DC resistance of said resistor is set, such that with loss in a high-frequency signal entering into said first input-output terminal and exiting from said second input-output terminal defined as insertion loss, and with loss in a high-frequency signal entering into said second input-output terminal and exiting from said first input-output terminal defined as isolation loss, said insertion loss is smaller than said isolation loss, and that said isolation loss increases as a static magnetic field applied to said two-port isolator from outside increases, wherein said sesistor has a DC resistance of 60–100Ω and common terminal is connected to a ground.

4. The two-port isolator according to claim 2, wherein the isolation loss of said two-port isolator increases by 1 dB or more, when a static magnetic field applied to said two-port isolator from outside increases by 800 A/m or more.

5. The two-port isolator according to claim 3, wherein said isolation loss is 10 dB or more in a frequency range of 0.8 $f_0$ to 3 $f_0$, wherein $f_0$ is a frequency at which said insertion loss is minimum.

6. The two-port isolator according to claim 3, wherein a static magnetic field applied to said two-port isolator from outside is increased by bringing a permanent magnet close to a casing serving as a magnetic yoke of said two-port isolator from above.

7. The two-port isolator according to claim 6, wherein said isolation loss increases by 1 dB or more, when a permanent magnet having a residual magnetic flux density of 0.5 T or more is brought close to said casing within 50 mm from above.

8. A method for evaluating a two-port isolator comprising a thin ferrite plate, a permanent magnet for applying a static magnetic field to said thin ferrite plate, first and second central conductors disposed substantially in a center portion of said thin ferrite plate and crossing each other with electric insulation, first and second input-output terminals each connected to an end of each of said first and second central conductors, a common terminal connected to the other ends of said first and second central conductors, a first matching capacitor connected between said first input-output terminal and said common terminal, a second matching capacitor connected between said second input-output terminal and said common terminal, and a resistor connected between said first input-output terminal and said second input-output terminal in a casing, said method comprising connecting said two-port isolator to an outside circuit; gradually bringing a permanent magnet close to said casing from outside to observe isolation while increasing a static magnetic field, wherein if said isolation loss increases by 1 dB or more when said static magnetic field increases by 800 A/m or more, it is determined that said resistance is properly larger than an outside circuit impedance (impedance of said outside circuit viewed from said two-port isolator), whereby the resistance of said resistor is judged good.

9. The method for evaluating a two-port isolator according to claim 8, wherein the resistance of said resistor is set such that said isolation loss is 10 dB or more in a frequency range of 0.8 $f_0$ to 3 $f_0$, wherein $f_0$ is a frequency at which said insertion loss is minimum.

10. The method for evaluating a two-port isolator according to claim 9, wherein the resistance of said resistor is set such that said isolation loss is 10–20 dB.

* * * * *

UNITED STATES PATENT AND TRADEMARK OFFICE

CERTIFICATE OF CORRECTION

PATENT NO. : 6,940,360 B2
DATED : September 6, 2005
INVENTOR(S) : Shigeru Takeda et al.

It is certified that error appears in the above-identified patent and that said Letters Patent is hereby corrected as shown below:

Column 20,
Line 1, “sesistor” should read -- resistor --.
Line 2, insert -- said -- before “common”.
Line 3, “claim 2” should read -- claim 3 --.

Signed and Sealed this

First Day of November, 2005

JON W. DUDAS
*Director of the United States Patent and Trademark Office*

UNITED STATES PATENT AND TRADEMARK OFFICE

CERTIFICATE OF CORRECTION

PATENT NO. : 6,940,360 B2
APPLICATION NO. : 10/108360
DATED : September 6, 2005
INVENTOR(S) : Shigeru Takeda et al.

It is certified that error appears in the above-identified patent and that said Letters Patent is hereby corrected as shown below:

Title page,
Item [73], Assignee, change "Hitchi Metals Ltd." to -- Hitachi Metals Ltd. --.

Signed and Sealed this

Twentieth Day of June, 2006

JON W. DUDAS
*Director of the United States Patent and Trademark Office*